US006563409B2

(12) United States Patent
Gruner

(10) Patent No.: US 6,563,409 B2
(45) Date of Patent: May 13, 2003

(54) LATCHING MAGNETIC RELAY ASSEMBLY

(76) Inventor: Klaus A. Gruner, 1275 Broadway, Village of Lakewood, IL (US) 60014

( * ) Notice: Subject to any disclaimer, the term of this patent is extended or adjusted under 35 U.S.C. 154(b) by 65 days.

(21) Appl. No.: 09/817,655

(22) Filed: Mar. 26, 2001

(65) Prior Publication Data

US 2002/0135447 A1 Sep. 26, 2002

(51) Int. Cl.[7] ..... H01H 67/02

(52) U.S. Cl. ..... 335/136; 335/106; 335/107; 335/127; 335/132

(58) Field of Search ..... 335/6, 129, 132, 335/177, 180, 106, 107, 119, 121, 127, 128, 131, 136

(56) References Cited

U.S. PATENT DOCUMENTS 4,092,620 A 5/1978 Schuessler
4,101,855 A 7/1978 Drapean
4,506,242 A * 3/1985 Karpe et al. ..... 335/119
4,795,994 A 1/1989 Hoffman
5,546,061 A 8/1996 Okabayashi
5,880,655 A 3/1999 Dittmann et al.

* cited by examiner

*Primary Examiner*—Ramon M. Barrera
(74) *Attorney, Agent, or Firm*—Charles F. Meroni, Jr.; Meroni & Meroni, P.C.

(57) ABSTRACT

A latching magnetic relay assembly comprises a relay motor with a first coil bobbin having a first excitation coil wound therearound and a second coil bobbin having a second excitation coil wound therearound, both said first excitation coil and said second excitation coil being identical, said first excitation coil being electrically insulated from said second excitation coil; an actuator assembly magnetically coupled to both said relay motor, said actuator assembly having a first end and a second end; and one or two groups of contact bridge assemblies, each of said group of contact bridge assemblies comprising a contact bridge and a spring.

108 Claims, 10 Drawing Sheets

LATCHING MAGNETIC RELAY ASSEMBLY

BACKGROUND OF THE INVENTION

1. Field of the Invention

The present invention relates generally to electromagnetic relays, more particularly, to a latching magnetic relay assembly with two electrically separated excitation coils capable of handling current transfers of up to and greater than 200 amps.

2. Description of the Prior Art

There are a few designs for latching magnetic relay assemblies currently in the prior art. These latching magnetic relay assemblies typically include a relay motor assembly that is magnetically coupled to an actuation assembly. The actuation assembly is then operatively coupled to a contact spring that is positioned opposite a pair of conductively isolated contact points. The relay motor typically drives the actuation assembly which in turn drives the contact spring into contact with a pair of contact points positioned directly across from it.

The conductive springs typically serve a dual purpose. They ensure good contact with the contact points, and they form a conductive pathway between the contact points. Conductive springs are typically made of copper or a copper alloy, the copper alloys typically have lower conductivity than plain copper. Plain copper can typically sustain less than 20 amps per square millimeter without causing excess heat build up in the copper. Excess heat build up in the conductive springs will cause the conductive spring to lose their spring property. This results in a loss of contact pressure, which leads to increased contact resistance which in turn causes the relay to fail. Consequently, most latching magnetic relays can only sustain currents of less than 20 amps per square millimeter through their copper conductive springs.

In order to increase current density while minimizing the heat generated by higher currents only two options are currently available. One is to make the conductive spring wider, requiring an increase in the size of the relay and increasing the bending force needed by the actuator assembly and the relay motor. The other option to increase the thickness of the spring which will also increase the bending force needed by the actuator assembly and the relay motor. Consequently, typical latching magnetic relays are not particularly suited for applications which require higher current flows of up to 100 amps.

U.S. Pat. No. 4,092,620 issued to Schuessler et al. discloses an electrical connection for the moving contacts of a relay. This invention provides an improved electrical connection for the moving contacts of a relay which simplifies the assembly operation. Specifically, this invention provides an electrical connection between a contact pin in the header of a relay and the pivoting blades supporting the moving contacts of the relay switch. The electrical connection is in the form of a cantilever spring contact having one end attached permanently to a contact pin by a supporting bracket, the cantilevered spring extending substantially parallel to the blade supporting the moving contacts of the switch. The free end of the cantilever spring is formed with a curved projecting portion which is urged by the spring against the surface of the contact blade adjacent the pivotal axis of the blade.

U.S. Pat. No. 4,101,855 issued to Drapeau discloses a miniature relay. This invention provides a miniature relay comprising an electromagnet assembly including a coil carried by a magnetic frame, the electromagnet being fixed to a supporting member of non-magnetic material which, in turn, is fixed to a header containing an assembly of stationary and movable contact members electrically coupled to terminal pins extending through the header. The magnetic frame includes a core portion extending longitudinally through and beyond the coil and terminating in an end facing the header, and the frame also includes a pole piece portion operatively associated with the coil. An armature is held in position by cooperation between a pair of spaced-apart holding elements extending from the electromagnet assembly and a portion of the armature shaped and dimensioned to fit in the region between the holding elements. The spaced-apart holding elements provide a saddle for the armature portion, and the armature is continuously urged into that saddle by biasing means carried by the header. The pull in force of the electromagnet can be enhanced by a mating tab and notch configuration in cooperating portions of the armature and pole piece or by a pole piece end portion disposed to present increased surface area to the armature.

U.S. Pat. No. 4,795,994 issued to Hoffmann discloses an electromechanical DC-RF relay. This invention includes a structure for an electromagnetic relay that provides high reliability and resistance to environmental extremes of shock, acceleration, vibration, temperature, and humidity, while providing a fast acting relay action in a configuration suitable for signal frequencies from DC to about 8 GHz. This invention includes a slider comprising a permanent magnet embedded in a non-conductive material slotted to loosely receive a mid-portion of at least one contact reed. One end of the contact reed is pivotally connected to an input pin of the relay, such that the contact reed can pivot from a first position to a second position while remaining in electrical contact with the input pin. The slider is situated such that the other end of the contact reed is normally in electrical contact with a first output pin, held there by magnetic attraction of the permanent magnet to the relay electromagnet. When the electromagnet of the relay is activated, the slider is repelled from the electromagnet, causing the contact reed to be pivoted away from the first contact pin until it stops in electrical contact against a second output pin. The contact reed slides within the slot of the slider as the contact reed pivots. No hard-stop adjustment or other adjustment is needed.

U.S. Pat. No. 5,546,061 issued to Okabayashi et al. discloses a plunger type electromagnetic relay with arc extinguishing structure. According to one aspect of this invention, there is provided an electromagnetic relay which comprises a movable contact retainer having disposed thereon a pair of movable contacts, a stationary contact retainer having disposed thereon a pair of stationary contacts at a given interval away from the movable contacts, a magnetically driving means for selectively driving the stationary contact retainer to bring the stationary contacts into engagement with and disengagement from the movable contacts, and a pair of permanent magnets having magnetic poles oriented opposite each other across the pair of the movable contacts retained on the movable contact retainer. According to another aspect of this invention, there is provided an electromagnetic relay which comprises a movable contact retainer having disposed thereon a pair of movable contacts, a stationary contact retainer having disposed thereon a pair of stationary contacts at a given interval away from the movable contacts, a magnetically driving means for selectively driving the stationary contact retainer to bring the stationary contacts into engagement with and disengagement from the movable contacts, and a pair of permanent magnets having magnetic poles oriented, in alignment with a current flow through the movable contact retainer, diametrically opposite each other across the pair of the movable contacts retained on the movable contact retainer.

U.S. Pat. No. 5,880,655 issued to Dittmann et al. discloses an electromagnetic relay. The relay of this invention includes a coil assembly enclosed in a top enclosure made from insulating material. The coil assembly includes a spooled coil body, a core, pole shoes and winding terminal elements assembly and is disposed above a pivoting armature which is connected to contact springs via a carrier element of insulating material. The relay of this invention also includes a base made from insulating material and which contains terminal paths for stationary cooperating contact elements as well as contact terminal elements. The armature is disposed above the base via bearing supports and bearing bands integrated in the contact springs. A frame is disposed over the base and forms a housing for the relay together with the base and with the top enclosure. The housing encapsulates the contact space of the relay, wherein the frame with the base represents the lower housing part and the top enclosure for the coil assembly represents the upper housing part.

In order to accomplish the goal of transferring currents of up to 100 amps for use in regulating the transfer of electricity or in other applications requiring the switching of current of up to 100 amps, a latching magnetic relay assembly with a linear motor is invented. U.S. Pat. No. 6,046,660 issued to Gruner disclosed a latching magnetic relay assembly with a linear motor. This invention is a latching magnetic relay capable of transferring currents of greater than 100 amps for use in regulating the transfer of electricity or in other applications requiring the switching of currents of greater than 100 amps. A relay motor assembly has an elongated coil bobbin with an axially extending cavity therein. An excitation coil is wound around the bobbin. A generally U shaped ferromagnetic frame has a core section disposed in and extending through the axially extending cavity in the elongated coil bobbin. Two contact sections extend generally perpendicularly to the core section and rises above the motor assembly. An actuator assembly is magnetically coupled to the relay motor assembly. The actuator assembly is comprised of an actuator frame operatively coupled to a first and a second generally U-shaped ferromagnetic pole pieces, and a permanent magnet. A contact bridge made of a sheet of conductive material copper is operatively coupled to the actuator assembly. However, there has never been disclosed a latching magnetic relay with two electrically separated excitation coils capable of handling currents of up to 200 amps.

Accordingly, there is a need for a latching magnetic relay, which is capable of handling currents of up to 200 amps.

Accordingly, there is a need for a latching magnetic relay, which is capable of performing the function of two latching magnetic relays.

The present invention is a latching magnetic relay assembly with two electrically insulated excitation coil capable of transferring currents of up to 200 amps for use in regulating the transfer of electricity or in other applications requiring the switching of currents of up to 200 amps.

SUMMARY OF THE INVENTION

A latching magnetic relay assembly in present invention comprises a relay motor with a first coil bobbin having a first excitation coil wound therearound and a second coil bobbin having a second excitation coil wound therearound, an actuator assembly magnetically coupled to the relay motor, the actuator assembly having a first end and a second end, a first means for conductive contact, the first means for conductive contact operatively coupled to the first end of the actuator assembly, the movement of the actuator assembly either driving the first means for conductive contact into contact with a first pair of contact points positioned directly opposite the first means for conductive contact, the first means for conductive contact acting as a first conductive pathway between the first pair of contact points, or driving the first means for conductive contact into breaking contact with the first pair of contact points, each of the first pair of contact points connecting to a first blow-out magnet, the movement of the actuator assembly initiated by the relay motor assembly, and a second means for conductive contact, the second means for conductive contact operatively coupled to the second end of the actuator assembly, the movement of the actuator assembly either driving the second means for conductive contact into contact with a second pair of contact points positioned directly opposite the second means for conductive contact, the second means for conductive contact acting as a second conductive pathway between the second pair of contact points, or driving the second means for conductive contact into breaking contact with the second pair of contact points, each of the second pair of contact points connecting to a second blow-out magnet, the movement of the actuator assembly initiated by the relay motor assembly.

The latching magnetic relay in present invention further comprises a housing having a top cover and a bottom cover with a plurality of top contact terminal assemblies and a plurality of bottom contact terminal assemblies attached thereto and extending through walls of the housing, the relay motor, the actuator assembly, the first means for conductive contact, and the second means for conductive contact being disposed within the housing, the top contact terminal assembly having the first pair of contact points positioned across the first means for conductive contact, a first gap of at least 1.6 mm separating the first means for conductive contact and each of the first pair of contact points, the bottom contact terminal assembly having the second pair of contact points positioned across the second means for conductive contact, a second gap of at least 1.6 mm separating the second means for conductive contact and each of the second pair of contact points.

Both the first means for conductive contact and the second means for conductive contact are made of copper and have a width of 10 millimeters and a thickness of 1 millimeter. A plurality of first means for conductive contact are operatively coupled to the first end of the actuator assembly, and a plurality of second means for conductive contact are operatively coupled to the second end of the actuator assembly. A plurality of first pairs of contact buttons are conductively connected to the first means for conductive contact. A plurality of second pairs of contact buttons are conductively connected to the second means for conductive contact.

In a preferred embodiment of the present invention, the first means for conductive contact is in breaking contact with the first pair of contact points when the second means for conductive contact is into contact with the second pair of contact points, and the second means for conductive contact is in breaking contact with the second pair of contact points when the first means for conductive contact is into contact with the first pair of contact points.

In a second embodiment of the present invention, the first means for conductive contact is in breaking contact with the first pair of contact points when the second means for conductive contact is in breaking contact with the second pair of contact points, and the second means for conductive contact is into contact with the second pair of contact points when the first means for conductive contact is into contact with the first pair of contact points.

In a third embodiment of the present invention, a latching magnetic relay assembly comprises a relay motor with a first coil bobbin having a first excitation coil wound therearound and a second coil bobbin having a second excitation coil wound therearound, an actuator assembly magnetically coupled to the relay motor, the actuator assembly having a first end and a second end, and a means for conductive contact, the means for conductive contact operatively coupled to the first end of the actuator assembly, the movement of the actuator assembly either driving the means for conductive contact into contact with a pair of contact points positioned directly opposite the means for conductive contact, the means for conductive contact acting as a conductive pathway between the pair of contact points, or driving the means for conductive contact into breaking contact with the pair of contact points, each of the pair of contact points connecting to a blow-out magnet, the movement of the actuator assembly initiated by the relay motor assembly.

DESCRIPTION OF THE PREFERRED EMBODIMENT

The present invention is an electromagnetic relay which has a contact assembly capable of handling current switching operations with higher current flow while maintaining a small overall package size; the present invention is an electromagnetic relay which has two independent excitation coils capable of handling different voltages; the present invention is also an electromagnetic relay with excitation coils that are easy to be wound.

Figure 1:
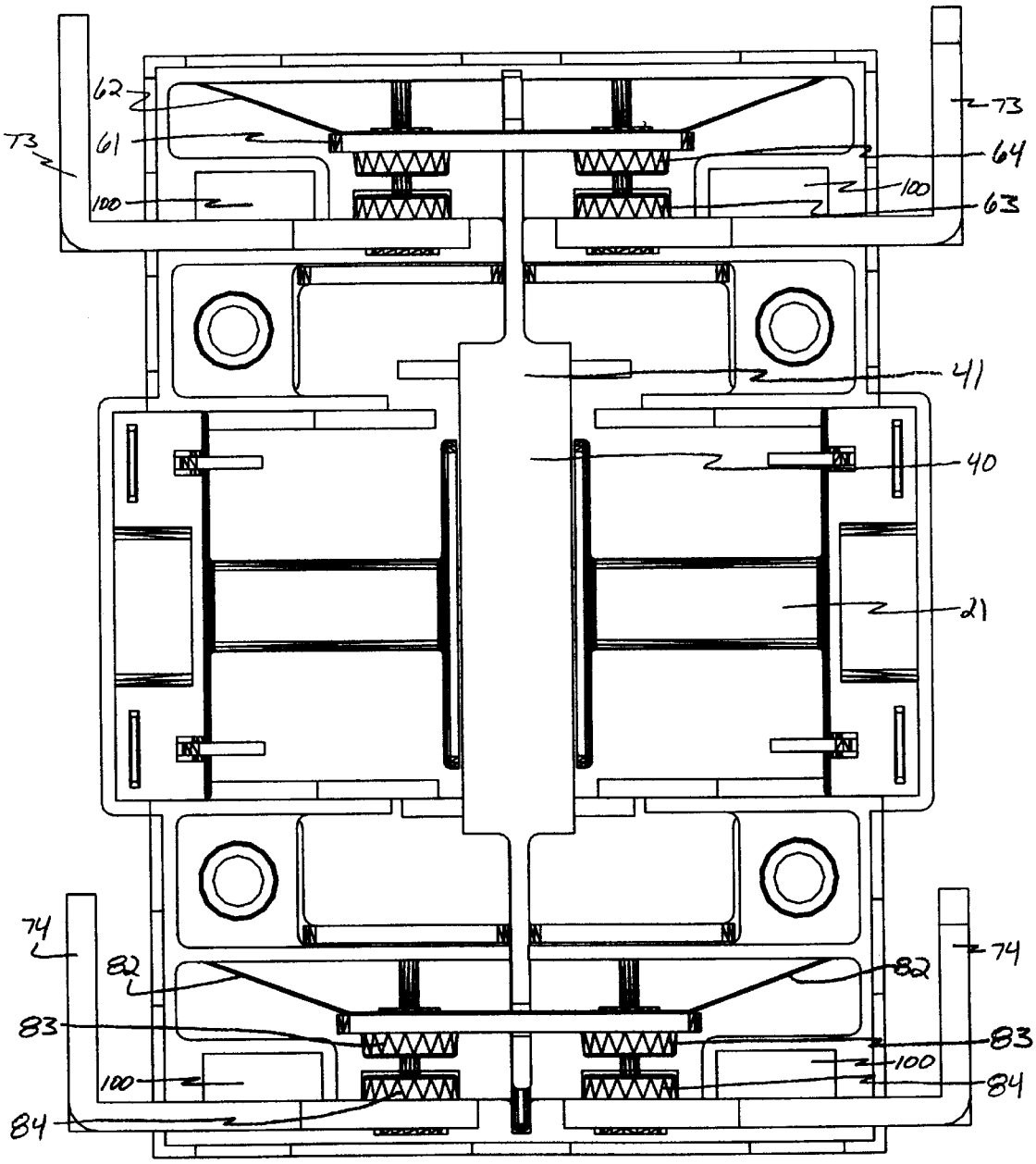
FIG. 1 is a side view of a relay motor coil bobbin with actuator assembly of the current invention.
Figure 2:
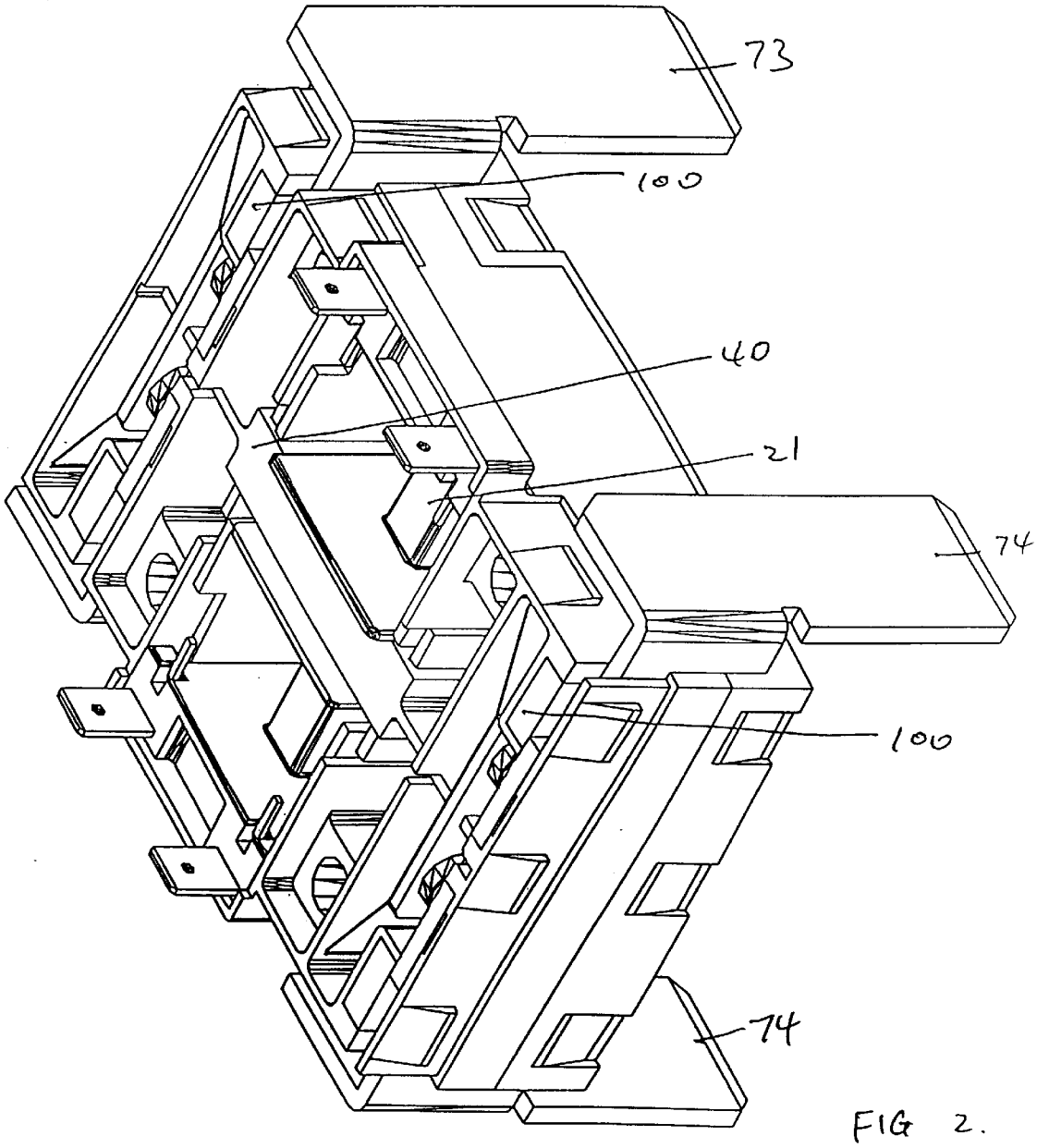
FIG. 2 is a prospective view of FIG. 1.
Figure 3:
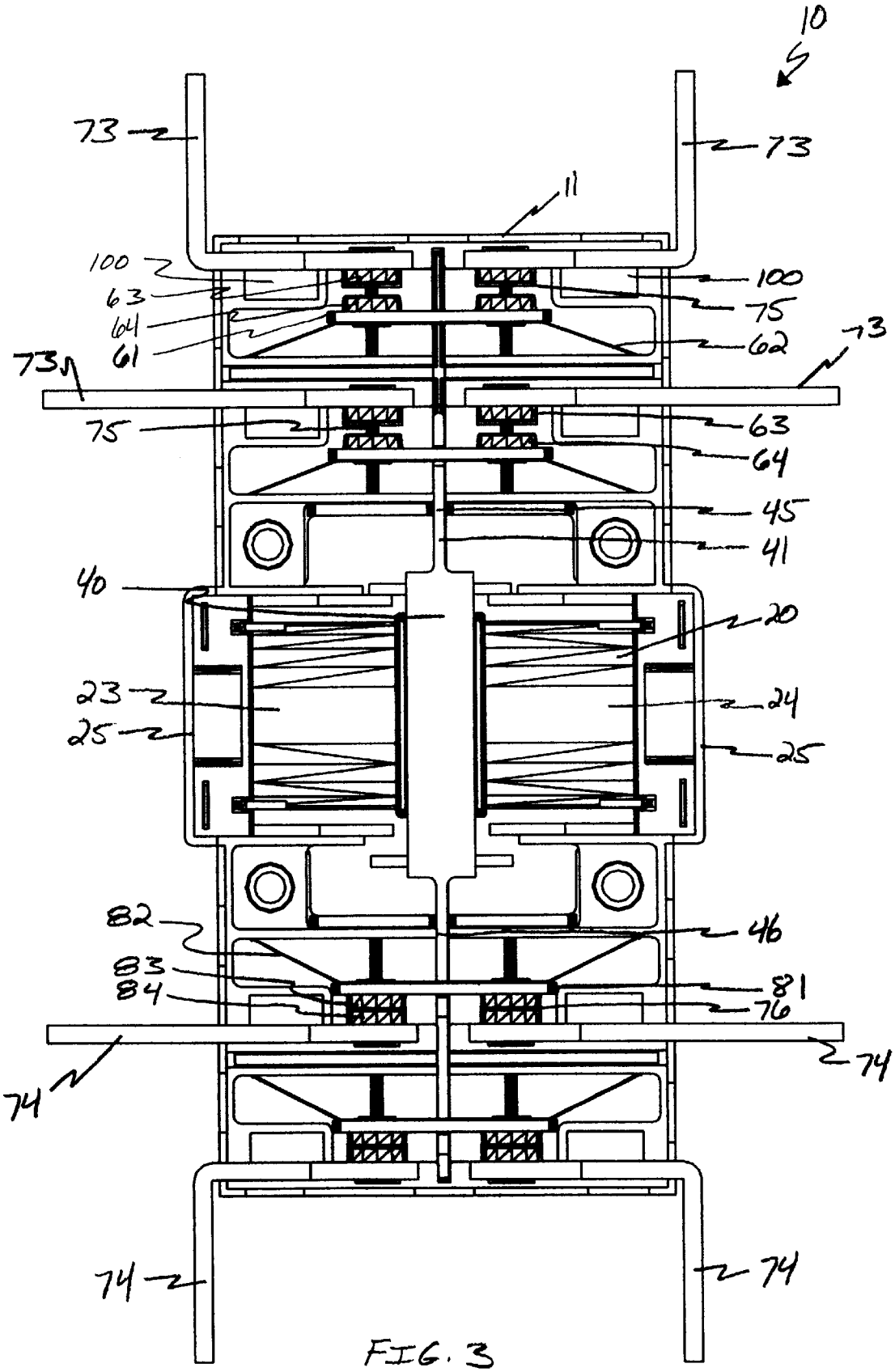
FIG. 3 is a side view of a preferred embodiment of the latching magnetic relay assembly without cover of the current invention.
Figure 4:
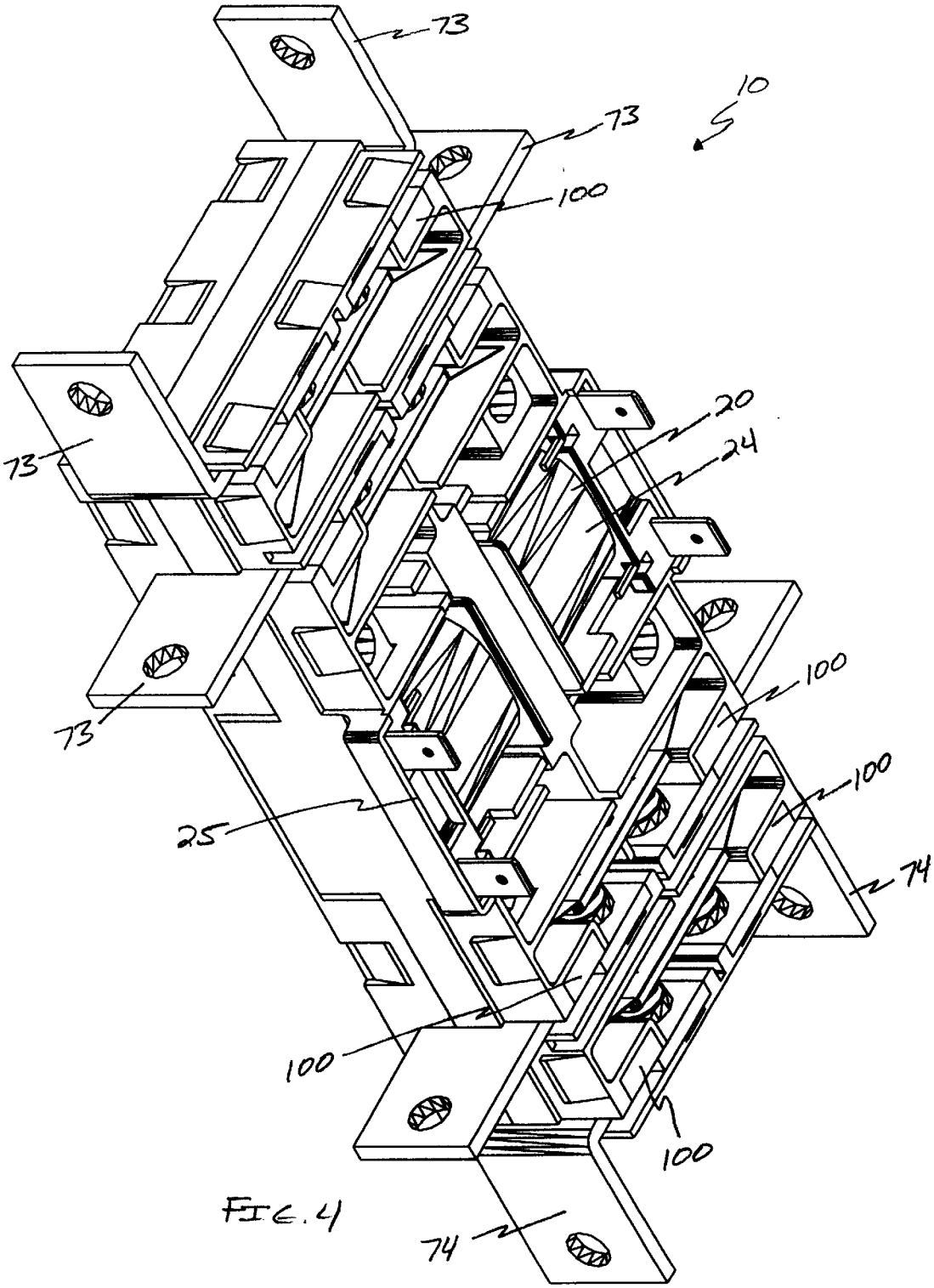
FIG. 4 is a prospective view of FIG. 3.
Figure 10A:
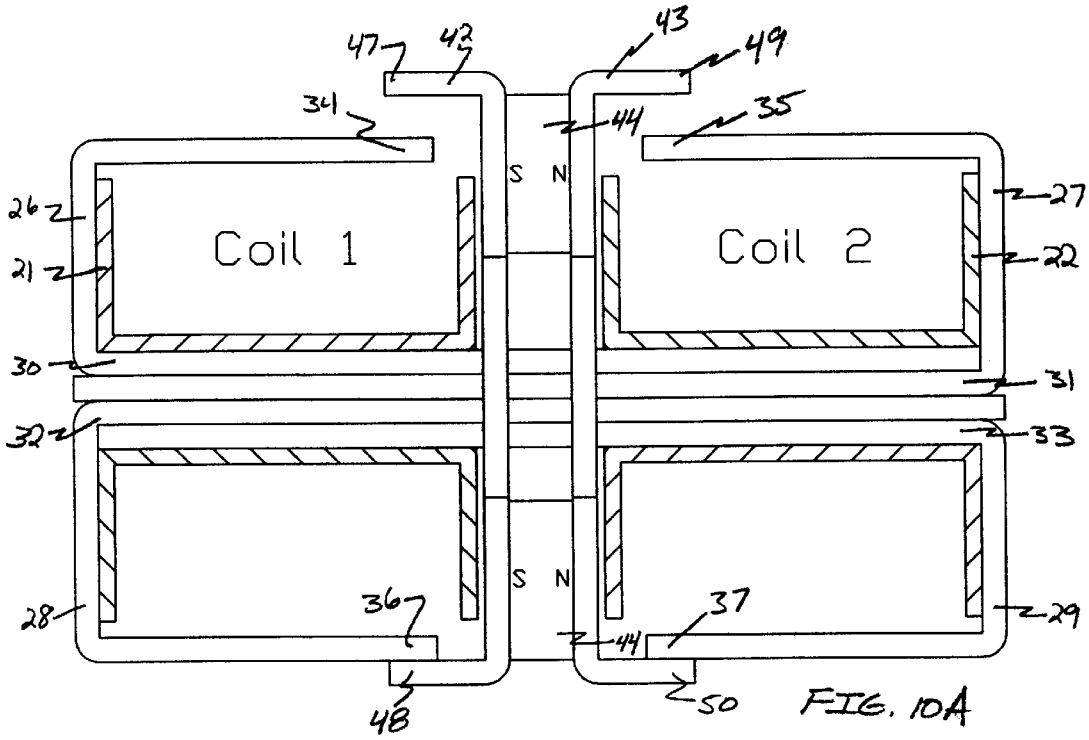
FIG. 10*a* and 10*b* are a schematic view of contact arrangement of the current invention.
Figure 10B:
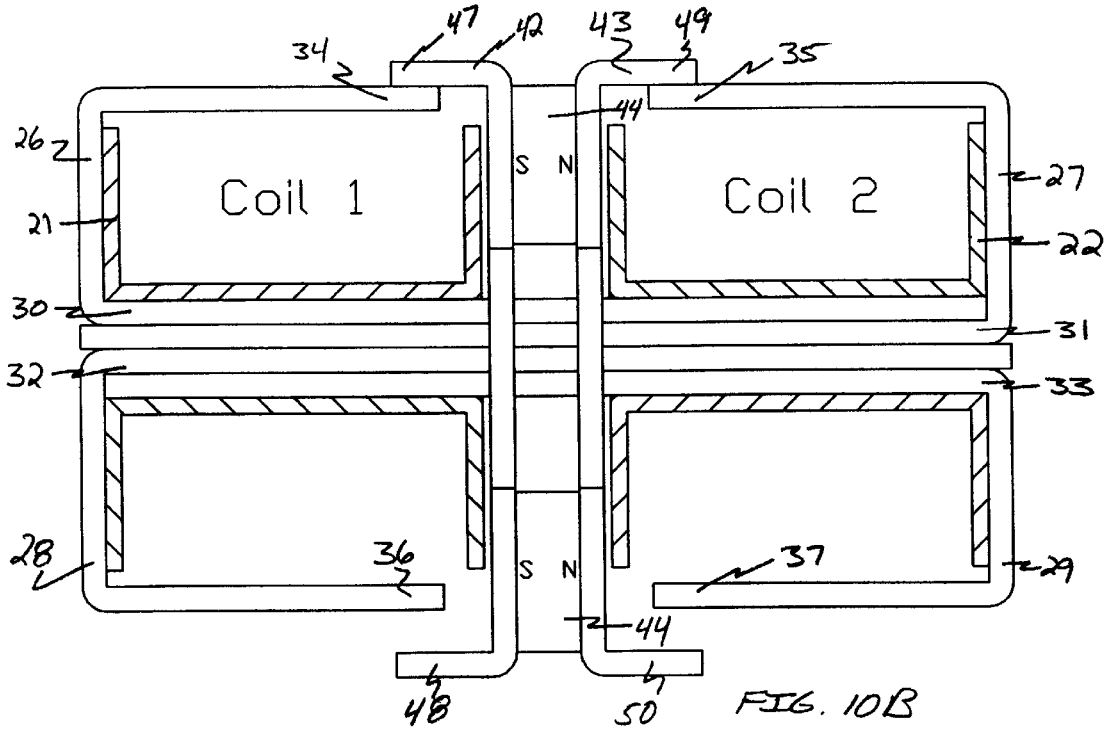

Referring now to FIGS. 1, 2, 3, 4 and 10, a latching magnetic relay assembly 10 of the present invention comprises a relay motor assembly 20 further comprising a first elongated coil bobbin 21 having a first excitation coil 23 wound therearound and a second elongated coil bobbin 22 having a second excitation coil 24 wound therearound, both the first excitation coil 23 and the second excitation coil 24 being identical, the first excitation coil 23 being electrically insulated from the second excitation coil 24, an axially extending cavity 25 within the first elongated coil bobbin 21 and the second elongated coil bobbin 22, a first generally J-shaped ferromagnetic frame 26, the first generally J-shaped ferromagnetic frame 26 having a first plurality of core sections 30 being disposed in and extending through the axially extending cavity 25 in both the first elongated coil bobbin 21 and the second elongated coil bobbin 22, the first contact section 34 of the first generally J-shaped ferromagnetic frame 26 extending generally parallel to the first plurality of core sections 30 and positioning above the first elongated coil bobbin 21, a second generally J-shaped ferromagnetic frame 27, the second generally J-shaped ferromagnetic frame 27 having a second plurality of core sections 31 being disposed in and extending through the axially extending cavity 25 in both the first elongated coil bobbin 21 and the second elongated coil bobbin 22, the second contact section 35 of the second generally J-shaped ferromagnetic frame 27 extending generally parallel to the second plurality of core sections 31 and positioning above the second elongated coil bobbin 22, a third generally J-shaped ferromagnetic frame 28, the third general J-shaped ferromagnetic frame 28 being same as the second general J-shaped ferromagnetic frame 27, the third generally J-shaped ferromagnetic frame 27 having a third plurality of core sections 32 being disposed in and extending through the axially extending cavity 25 in both the first elongated coil bobbin 21 and the second elongated coil bobbin 22, the third contact section 36 of the third generally J-shaped ferromagnetic frame 28 extending generally parallel to the third plurality of core sections 32 and positioning below the first elongated coil bobbin 21, and a fourth generally J-shaped ferromagnetic frame 29, the fourth generally J-shaped ferromagnetic frame 29 being same as the first general J-shaped ferromagnetic frame 26, the fourth generally J-shaped ferromagnetic frame 29 having a fourth plurality of core sections 33 being disposed in and extending through the axially extending cavity 25 in both the first elongated coil bobbin 21 and the second elongated coil bobbin 22, the fourth contact section 37 of the fourth generally J-shaped ferromagnetic frame 29 extending generally parallel to the fourth plurality of core sections 33 and positioning below the second elongated coil bobbin 22;

an actuator assembly 40 comprising an actuator frame 41 operatively coupled to a first generally U-shaped ferromagnetic pole piece 42 and a second generally U-shaped ferromagnetic pole piece 43, the first generally U-shaped ferromagnetic pole piece 42 and the second generally U-shaped ferromagnetic pole piece 43 being identical, and two permanent magnets 44, the two permanent magnets 44 being identical, the actuator assembly 40 having a first end 45 and a second end 46, the first generally U-shaped ferromagnetic pole piece 42 and the second generally U-shaped ferromagnetic pole piece 43 mounted in back-to-back relation, the first generally U-shaped ferromagnetic pole piece 42 having a fifth contact section 47 and a sixth contact section 48, the second generally U-shaped ferromagnetic pole piece 43 having a seventh contact section 49 and an eighth contact section 50, the two permanent magnets 44 lying sandwiched therebetween, the actuator assembly 40 positioned so the first contact section 34 and the third contact section 36 being located in between the fifth contact section 47 and the sixth contact section 48, the second contact section 35 and the fourth contact section 37 being located in between the seventh contact section 49 and the eighth contact section 50, the first generally U-shaped ferromagnetic pole piece 42 being located in overlapping relation across from the first contact section 34 and the third contact section 36, the second generally U-shaped ferromagnetic pole piece 43 being located in overlapping relation across from the second contact section 35 and the fourth contact section 37, the first generally U-shaped ferromagnetic pole piece 42 magnetically coupled to the first general J-shaped ferromagnetic frame 26 when the second generally U-shaped ferromagnetic pole piece 42 magnetically coupled to the second general J-shaped ferromagnetic frame 27, and the first general U-shaped ferromagnetic pole piece 42 magnetically coupled to the third general J-shaped ferromagnetic frame 28 when the second general U-shaped ferromagnetic pole piece 43 magnetically couple to the fourth general J-shaped ferromagnetic frame 29;

a first group of contact bridge assemblies 60, each of the first group of contact bridge assemblies 60 comprising a first contact bridge 61 and a first spring 62, the first group of contact bridges 60 made of a conductive material and operatively coupled to the first end 45 of the actuator assembly 40, the first spring 62 connected to the first contact bridge 61, the movement of the actuator assembly 40 either driving the first group of contact bridges 60 into contact with a first group of pairs of contact points 63 positioned directly opposite the first group of contact bridges 60, the first group of contact bridges 60 serving as a first conductive pathway between the first group of pairs of contact points 63, or driving the first group of contact bridges 60 into breaking contact with the first group of pairs of contact points 63, each of the first group of pairs of contact points 63 connecting to a first blow-out magnet 100, the movement of the actuator assembly 40 driven by the relay motor assembly 20; and a second group of contact bridge assemblies 80, each of the second group of contact bridge assemblies 80 comprising a second contact bridge 81 and a second spring 82, the second group of contact bridges 80 made of a conductive material and operatively coupled to the second end 46 of the actuator assembly 40, the second spring 82 connected to the second contact bridge 81, the movement of the actuator assembly 40 either driving the second group of contact bridges 81 into contact with a second group of pairs of contact points 83 positioned directly opposite the second group of contact bridges 81, the second group of contact bridges 81 serving as a second conductive pathway between the second group of pairs of contact points 83, or driving the second group of contact bridges 81 into breaking contact with the second group of pairs of contact points 83, each of the second group of pairs of contact points 83 connecting a second blow-out magnet 101, the second blow-out magnet 101 being identical to the first blow-out magnet 100, the movement of the actuator assembly 40 driven by the relay motor assembly 20.

Each of both the first group of contact bridges 61 and the second group of contact bridges 81 is made of copper and has a width of 10 millimeters and a thickness of 1 millimeter. A plurality of first groups of contact bridge assemblies 60 are operatively coupled to the first end 45 of the actuator assembly 40, the plurality of first groups of contact bridge assemblies 60 are electrically insulated from one another. A plurality of second groups of contact bridge assemblies 80 are operatively coupled to the second end 46 of the actuator assembly 40, the plurality of second groups of contact bridge assemblies 80 are electrically insulated from one another.

A plurality of first contact buttons 64 are conductively connected to each of the first group of contact bridges 61. A plurality of second contact buttons 84 are conductively connected to each of the second group of contact bridges 81.

The latching magnetic relay assembly 10 in the preferred embodiment further comprises a housing 110 having a top cover 71 and a bottom cover 72, the top cover 71 being identical to the bottom cover 72, a plurality of first contact terminal assemblies 73 and a plurality of second contact terminal assemblies 74 inserted into and extending through walls of the housing 110, the relay motor assembly 20, the actuator assembly 40, the first group of contact bridge assemblies 60, and the second group of contact bridge assemblies 80 being disposed within the housing 110, the first contact terminal assembly 73 having the first group of pairs of contact points 63 positioned across the first group of contact bridges 61, a first gap 75 of at least 1.6 mm separating each of the first group of contact bridges 61 and each of the first pair of contact points 63, the second contact terminal assembly 74 having the second group of pairs of contact points 83 positioned across the second group of contact bridges 81, a second gap 76 of at least 1.6 mm separating each of the second group of contact bridges 81 and each of the second pair of contact points 83.

The first group of contact bridges 61 are in breaking contact with the first group of pairs of contact points 63 when the second group of contact bridges 81 are into contact with the second group of pairs of contact points 83. The second group of contact bridges 81 are in breaking contact with the second group of pairs of contact points 83 when the first group of contact bridges 61 are into contact with the first group of pairs of contact points 63.

Figure 5:
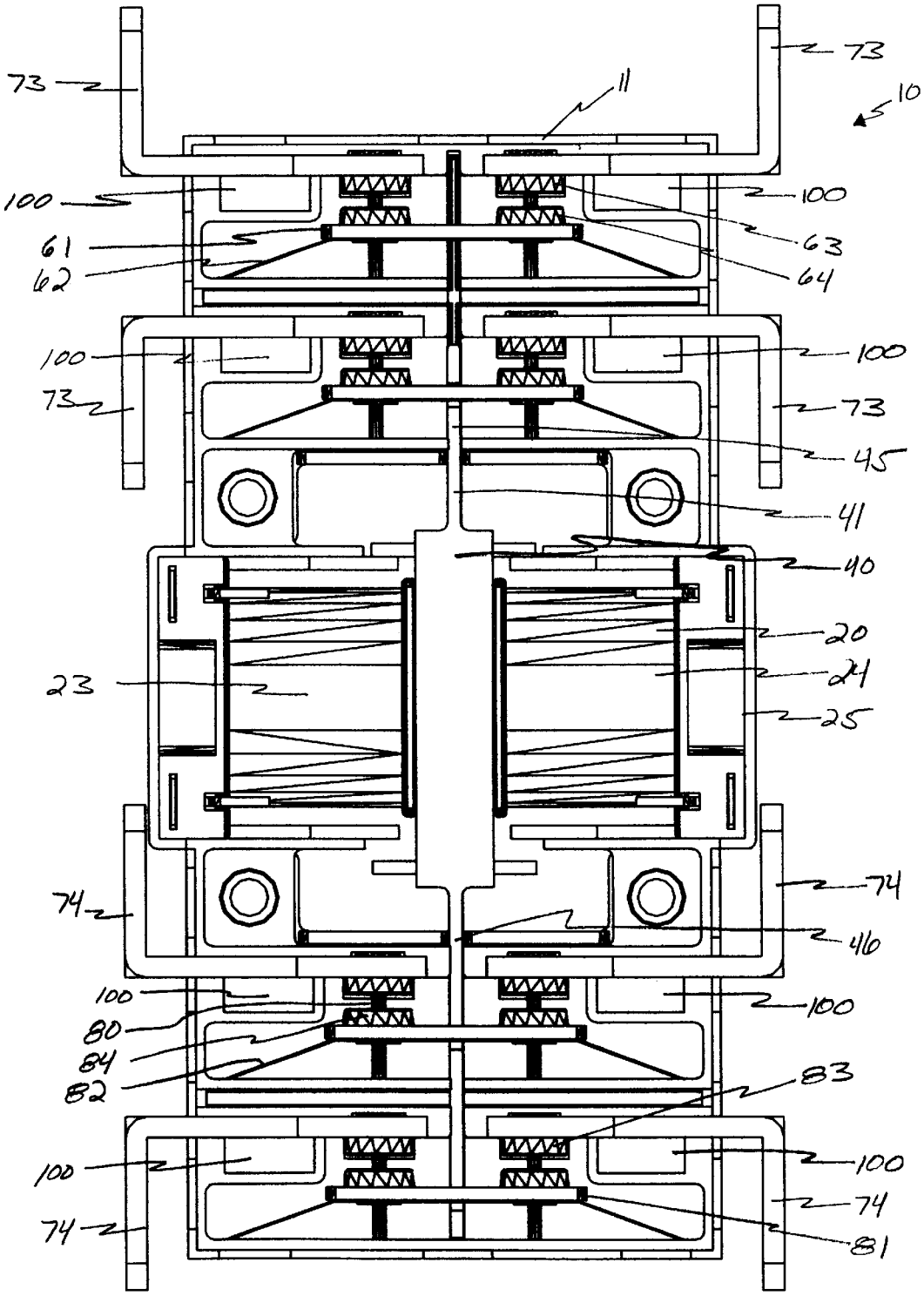
FIG. 5 is a side view of a second embodiment of the latching magnetic relay assembly without cover of the current invention.
Figure 6:
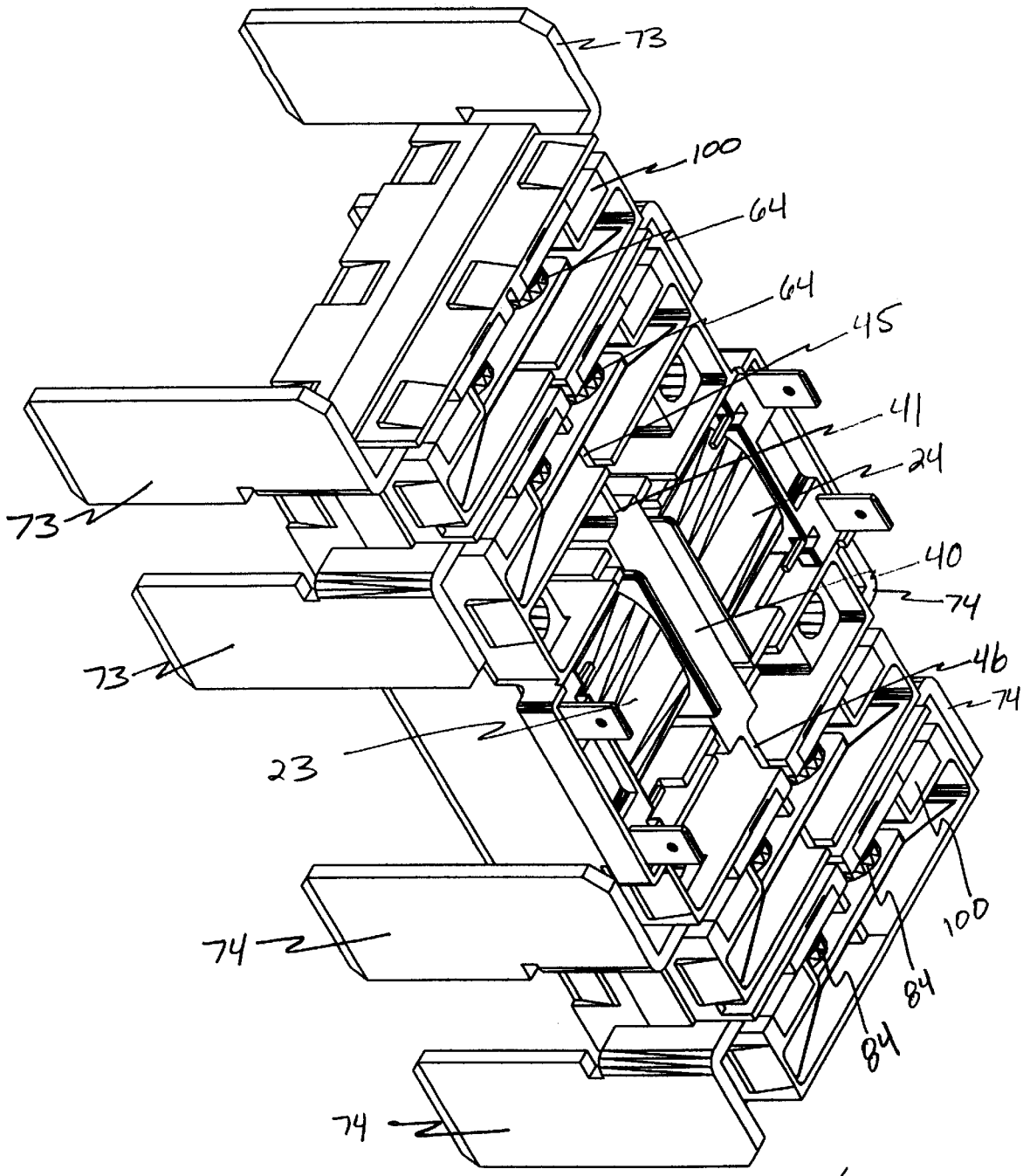
FIG. 6 is a prospective view of FIG. 5.

Referring now to FIGS. 1, 2, 5, 6 and 10, in a second embodiment of the current invention, the second group of contact bridges 81 are rearranged so that the first group of contact bridges 61 are in breaking contact with the first group of pairs of contact points 63 when the second group of contact bridges 81 are in breaking contact with the second group of pairs of contact points 83. The second group of contact bridges 81 are into contact with the second group of pairs of contact points 83 when the first group of contact bridges 61 are into contact with the first group of pairs of contact points 63.

Figure 7:
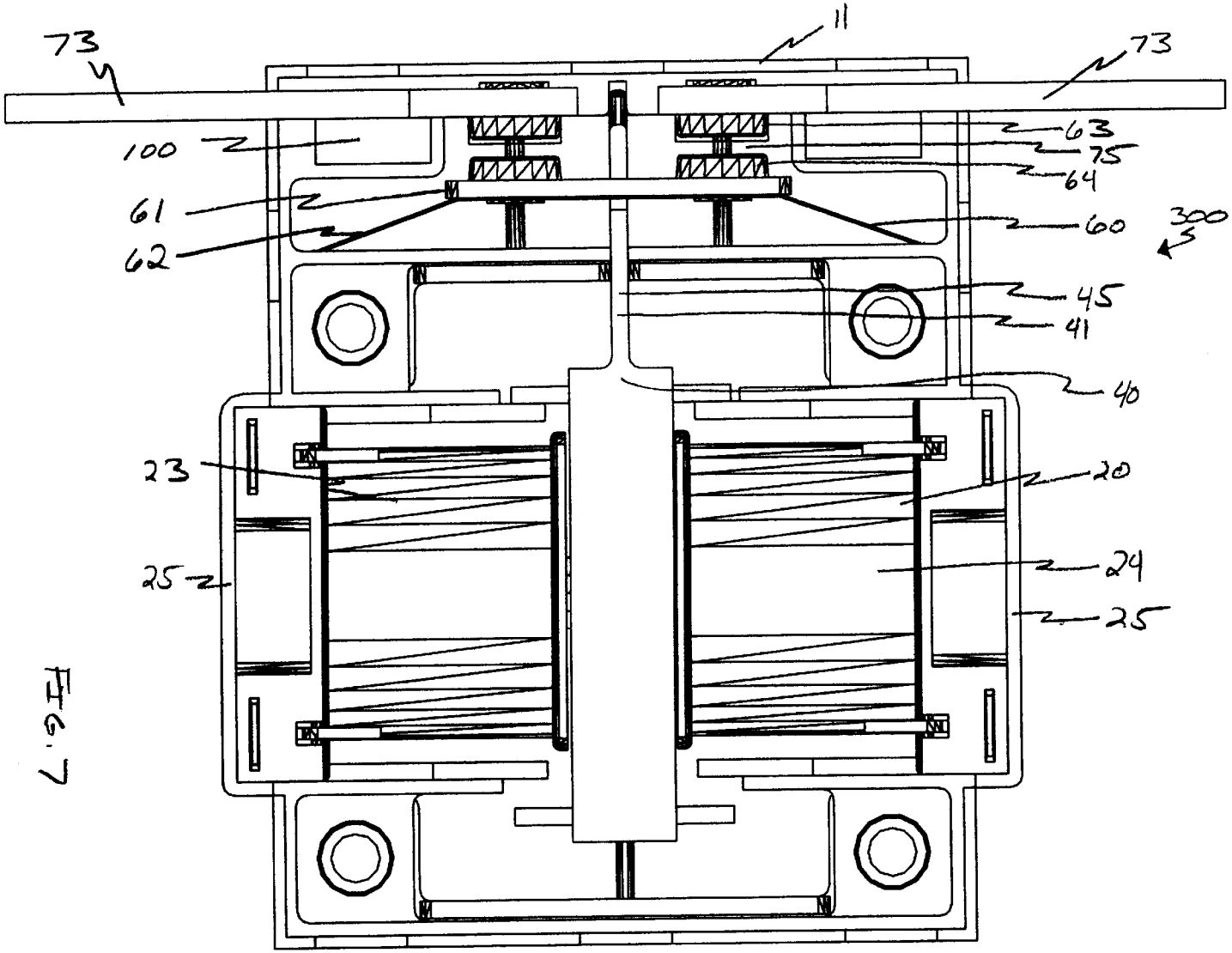
FIG. 7 is a side view of a third embodiment of the latching magnetic relay assembly without cover of the current invention.
Figure 8:
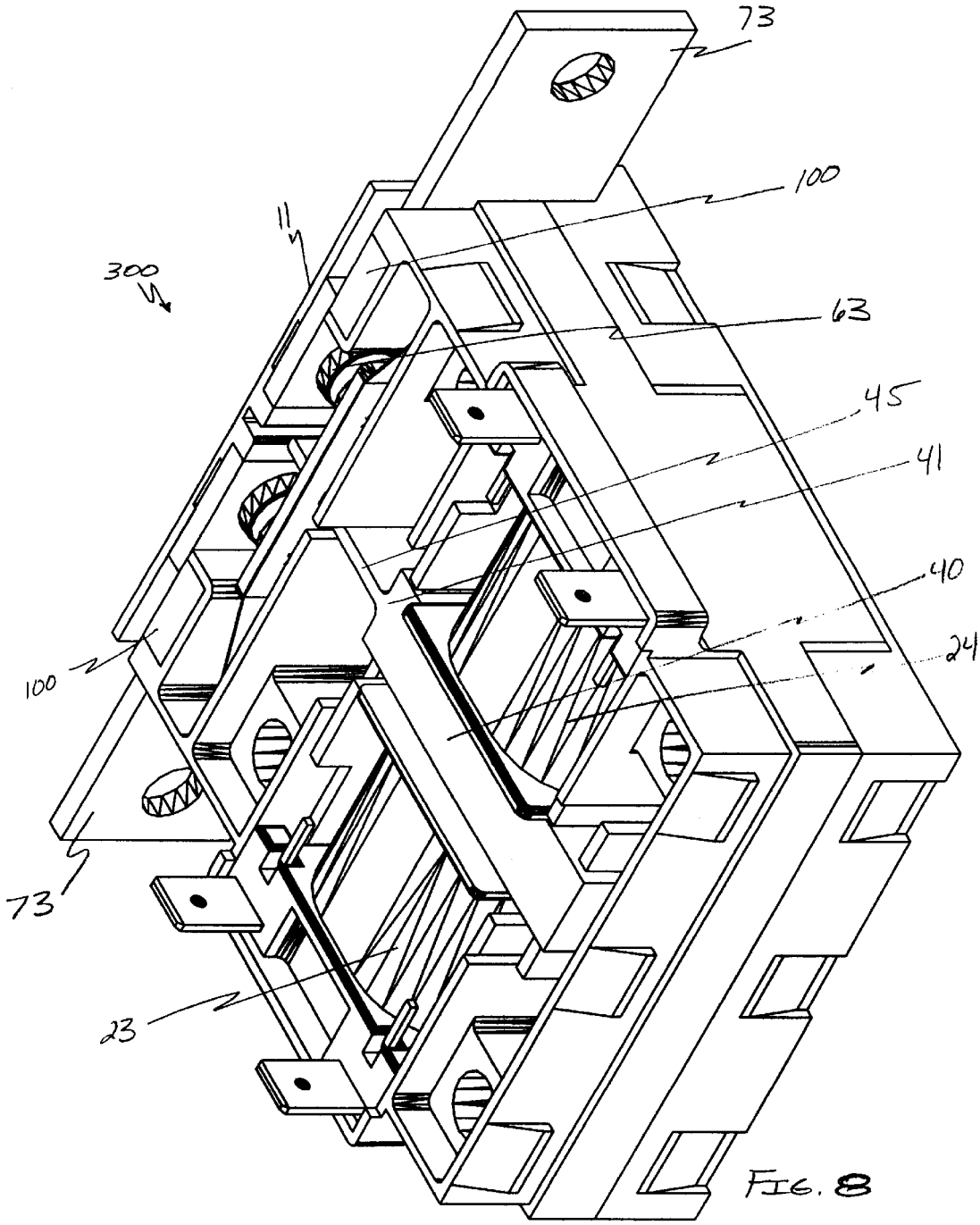
FIG. 8 is a prospective view of FIG. 7.
Figure 9:
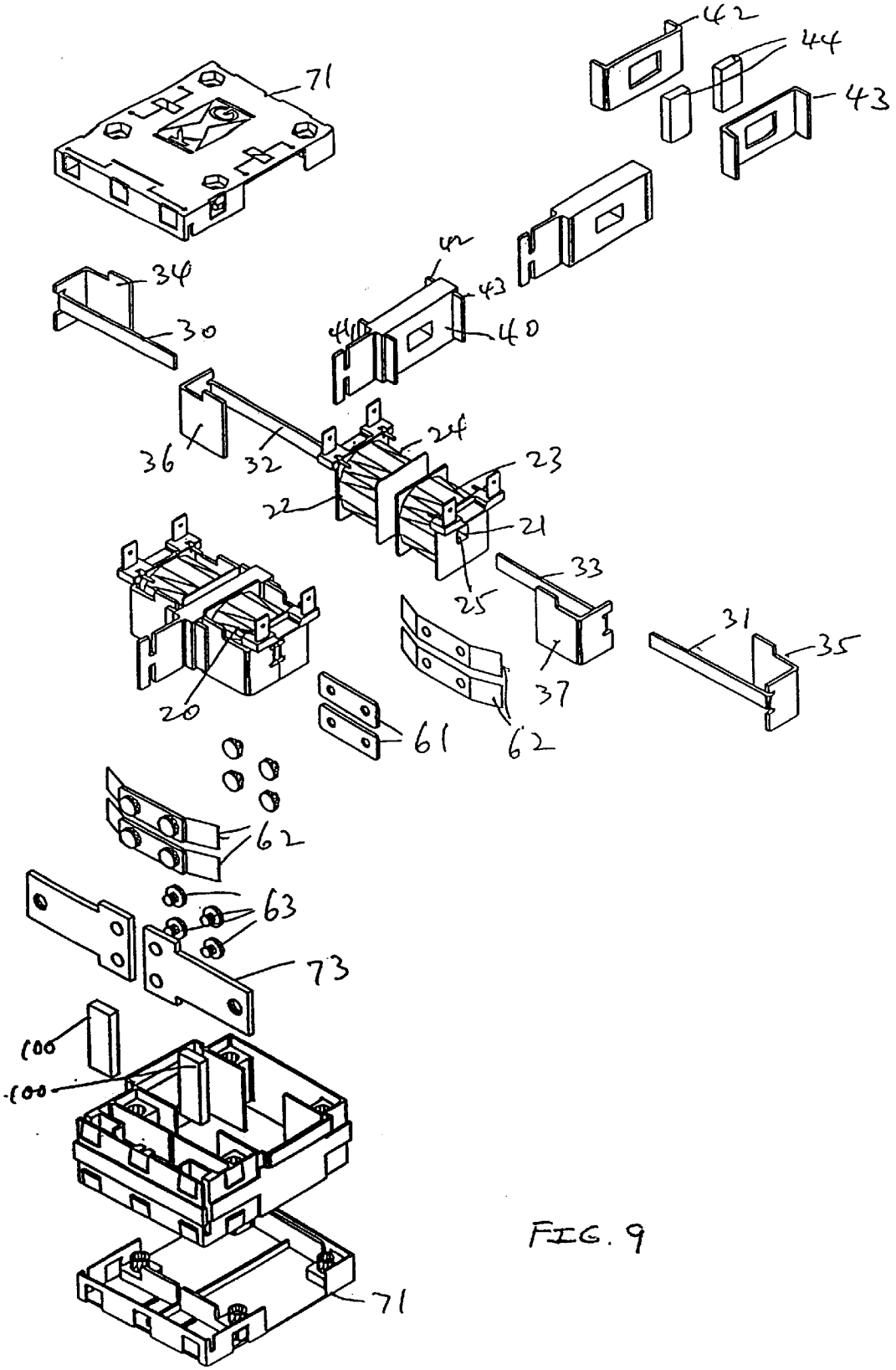
FIG. 9 is an explosive view of the third embodiment of the current invention.

Referring now to FIGS. 7, 8, 9 and 10, in a third embodiment of the current invention, a latching magnetic relay assembly 300 of the present invention comprises a relay motor assembly 20 further comprising a first elongated coil bobbin 21 having a first excitation coil 23 wound therearound and a second elongated coil bobbin 22 having a second excitation coil 24 wound therearound, both the first excitation coil 23 and the second excitation coil 24 being identical, the first excitation coil 23 being electrically insulated from the second excitation coil 24, an axially extending cavity 25 within the first elongated coil bobbin 21 and the second elongated coil bobbin 22, a first generally J-shaped ferromagnetic frame 26, the first generally J-shaped ferromagnetic frame 26 having a first plurality of core sections 30 being disposed in and extending through the axially extending cavity 25 in both the first elongated coil bobbin 21 and the second elongated coil bobbin 22, the first contact section 34 of the first generally J-shaped ferromagnetic frame 26 extending generally parallel to the first plurality of core sections 30 and positioning above the first elongated coil bobbin 21, a second generally J-shaped ferromagnetic frame 27, the second generally J-shaped ferromagnetic frame 27 having a second plurality of core sections 31 being disposed in and extending through the axially extending cavity 25 in both the first elongated coil bobbin 21 and the second elongated coil bobbin 22, the second contact section 35 of the second generally J-shaped ferromagnetic frame 27 extending generally parallel to the second plurality of core sections 31 and positioning above the second elongated coil bobbin 22, a third generally J-shaped ferromagnetic frame 28, the third general J-shaped ferromagnetic frame 28 being same as the second general J-shaped ferromagnetic frame 27, the third generally J-shaped ferromagnetic frame 27 having a third plurality of core sections 32 being disposed in and extending through the axially extending cavity 25 in both the first elongated coil bobbin 21 and the second elongated coil bobbin 22, the third contact section 36 of the third generally J-shaped ferromagnetic frame 28 extending generally parallel to the third plurality of core sections 32 and positioning below the first elongated coil bobbin 21, and a fourth generally J-shaped ferromagnetic frame 29, the fourth generally J-shaped ferromagnetic frame 29 being same as the first general J-shaped ferromagnetic frame 26, the fourth generally J-shaped ferromagnetic frame 29 having a fourth plurality of core sections 33 being disposed in and extending through the axially extending cavity 25 in both the first elongated coil bobbin 21 and the second elongated coil bobbin 22, the fourth contact section 37 of the fourth generally J-shaped ferromagnetic frame 29 extending generally parallel to the fourth plurality of core sections 33 and positioning below the second elongated coil bobbin 22;

an actuator assembly 40 comprising an actuator frame 41 operatively coupled to a first generally U-shaped ferromagnetic pole piece 42 and a second generally U-shaped ferromagnetic pole piece 43, the first generally U-shaped ferromagnetic pole piece 42 and the second generally U-shaped ferromagnetic pole piece 43 being identical, and two permanent magnets 44, the two permanent magnets 44 being identical, the actuator assembly 40 having a first end 45 and a second end 46, the first generally U-shaped ferromagnetic pole piece 42 and the second generally U-shaped ferromagnetic pole piece 43 mounted in back-to-back relation, the first generally U-shaped ferromagnetic pole piece 42 having a fifth contact section 47 and a sixth contact section 48, the second generally U-shaped ferromagnetic pole piece 43 having a seventh contact section 49 and an eighth contact section 50, the two permanent magnets 44 lying sandwiched therebetween, the actuator assembly 40 positioned so the first contact section 34 and the third contact section 36 being located in between the fifth contact section 47 and the sixth contact section 48, the second contact section 35 and the fourth contact section 37 being located in between the seventh contact section 49 and the eighth contact section 50, the first generally U-shaped ferromagnetic pole piece 42 being located in overlapping relation across from the first contact section 34 and the third contact section 36, the second generally U-shaped ferromagnetic pole piece 43 being located in overlapping relation across from the second contact section 35 and the fourth contact section 37, the first generally U-shaped ferromagnetic pole piece 42 magnetically coupled to the first general J-shaped ferromagnetic frame 26 when the second generally U-shaped ferromagnetic pole piece 42 magnetically coupled to the second general J-shaped ferromagnetic frame 27, and the first general U-shaped ferromagnetic pole piece 42 magnetically coupled to the third general J-shaped ferromagnetic frame 28 when the second general U-shaped ferromagnetic pole piece 43 magnetically couple to the fourth general J-shaped ferromagnetic frame 29; and a group of contact bridge assemblies 60, each of the group of contact bridge assemblies 60 comprising a contact bridge 61 and a spring 62, the group of contact bridges 60 made of a conductive material and operatively coupled to the first end 45 of the actuator assembly 40, the spring 62 connected to the contact bridge 61, the movement of the actuator assembly 40 either driving the group of contact bridges 60 into contact with a group of pairs of contact points 63 positioned directly opposite the group of contact bridges 60, the group of contact bridges 60 serving as a conductive pathway between the group of pairs of contact points 63, or driving the group of contact bridges 60 into breaking contact with the group of pairs of contact points 63, each of the group of pairs of contact points 63 connecting to a blow-out magnet 100, the movement of the actuator assembly 40 driven by the relay motor assembly 20.

In the third embodiment, each of the group of contact bridges 61 is made of copper and has a width of 10 millimeters and a thickness of 1 millimeter. A plurality of the group of contact bridge assemblies 60 are operatively coupled to the first end 45 of the actuator assembly 40, the plurality of the group contact bridge assemblies 60 are electrically insulated from one another. A plurality of contact buttons 64 are conductively connected to each of the group of contact bridges 61.

The latching magnetic relay assembly 300 in the third embodiment further comprises a housing 110 having a top cover 71 and a bottom cover 72, and a plurality of contact terminal assemblies 73 inserted into and extending through walls of the housing 110, the relay motor assembly 20, the actuator assembly 40 and the group of contact bridge assemblies 60 being disposed within the housing 110, the contact terminal assembly 73 having the group of pairs of contact points 63 positioned across the group of contact bridges 61, a gap 75 of at least 1.6 mm separating each of the group of contact bridges 61 and each of the pair of contact points 63.

The group of contact bridges 61 are into contact with the group of pairs of contact points 63 when the sixth contact section 48 is into contact with the third contact section 36 and the eighth contact section 50 is into contact with the fourth contact section 37, and the group of contact bridges 61 are in breaking contact with the group of pairs of contact points 63 when the sixth contact section 48 is in breaking contact with the third contact section 36 and the eighth contact section 50 is in breaking contact with the fourth contact section 37. Another contact arrangement can be made so that the group of contact bridges 61 are into contact with the group of pairs of contact points 63 when the fifth contact section 47 is into contact with the first contact section 34 and the seventh contact section 49 is into contact with the second contact section 35, and the group of contact bridges 61 are in breaking contact with the group of pairs of contact points 633 when the fifth contact section 47 is in breaking contact with the first contact section 34, and the seventh contact section 49 is in breaking contact with the second contact section 35.

All the contact terminal assembly 73 or 74 can have different style to fit different needs.

Hence, the present invention provides a latching magnetic relay assembly with two electrically separated excitation coils capable of transferring currents of up to 200 amps for use in regulating the transfer of electricity or in other applications requiring the switching of currents up to 200 amps.

This invention also provides a latching magnetic relay assembly, which is capable of performing the function of two latching magnetic relays.

The foregoing descriptions of the preferred embodiments of the invention have been presented for purposes of illustration and description, and are not intended to be exhaustive or to limit the invention to the precise forms disclosed. The descriptions were selected to best explain the principles of the invention and their practical application to enable others skilled in the art to best utilize the invention in various embodiments and various modifications as are suited to be particular use contemplated. It is not intended that the novel device be limited thereby. The preferred embodiment may be susceptible to modifications and variations that are within the scope and fair meaning of the accompanying claims and drawings.

I claim:

1. A latching magnetic relay assembly comprising:

a relay motor assembly comprising a first elongated coil bobbin having a first excitation coil wound therearound and a second elongated coil bobbin having a second excitation coil wound therearound, both said first excitation coil and said second excitation coil being identical, said first excitation coil being electrically insulated from said second excitation coil an axially extending cavity within said first elongated coil bobbin and said second elongated coil bobbin, a first generally J-shaped ferromagnetic frame, said first generally J-shaped ferromagnetic frame having a first plurality of core sections being disposed in and extending through said axially extending cavity in both said first elongated coil bobbin and said second elongated coil bobbin, said first contact section of said first generally J-shaped ferromagnetic frame extending generally parallel to said first plurality of core sections and positioning above said first elongated coil bobbin, a second generally J-shaped ferromagnetic frame, said second generally J-shaped ferromagnetic frame having a second plurality of core sections being disposed in and extending through said axially extending cavity in both said first elongated coil bobbin and said second elongated coil bobbin, said second contact section of said second generally J-shaped ferromagnetic frame extending generally parallel to said second plurality of core sections and positioning above said second elongated coil bobbin, a third generally J-shaped ferromagnetic frame, said third general J-shaped ferromagnetic frame being same as said second general J-shaped ferromagnetic frame, said third generally J-shaped ferromagnetic frame having a third plurality of core sections being disposed in and extending through said axially extending cavity in both said first elongated coil bobbin and said second elongated coil bobbin, said third contact section of said third generally J-shaped ferromagnetic frame extending generally parallel to said third plurality of core sections and positioning below said first elongated coil bobbin, and a fourth generally J-shaped ferromagnetic frame, said fourth generally J-shaped ferromagnetic frame being same as said first general J-shaped ferromagnetic frame, said fourth generally J-shaped ferromagnetic frame having a fourth plurality of core sections being disposed in and extending through said axially extending cavity in both said first elongated coil bobbin and said second elongated coil bobbin, said fourth contact section of said fourth generally J-shaped ferromagnetic frame extending generally parallel to said fourth plurality of core sections and positioning below said second elongated coil bobbin;

an actuator assembly comprising an actuator frame operatively coupled to a first generally U-shaped ferromagnetic pole piece and a second generally U-shaped ferromagnetic pole piece, said first generally U-shaped ferromagnetic pole piece and said second generally U-shaped ferromagnetic pole piece being identical, and two permanent magnets, said two permanent magnets being identical, said actuator assembly having a first end and a second end, said first generally U-shaped ferromagnetic pole piece and said second generally U-shaped ferromagnetic pole piece mounted in back-to-back relation, said first generally U-shaped ferromagnetic pole piece having a fifth contact section and a sixth contact section, said second generally U-shaped ferromagnetic pole piece having a seventh contact section and a eighth contact section, said two permanent magnets lying sandwiched therebetween, said actuator assembly positioned so said first contact section and said third contact section being located in between said fifth contact section and said sixth contact section, said second contact section and said fourth contact section being located in between said seventh contact section and said eighth contact section, said first generally U-shaped ferromagnetic pole piece being located in overlapping relation across from said first contact section and said third contact section, said second generally U-shaped ferromagnetic pole piece being located in overlapping relation across from said second contact section and said fourth contact section, said first generally U-shaped ferromagnetic pole piece magnetically coupled to said first general J-shaped ferromagnetic frame when said second generally U-shaped ferromagnetic pole piece magnetically coupled to said second general J-shaped ferromagnetic frame, and said first general U-shaped ferromagnetic pole piece magnetically coupled to said third general J-shaped ferromagnetic frame when said second general U-shaped ferromagnetic pole piece magnetically couple to said fourth general J-shaped ferromagnetic frame;

a first group of contact bridge assemblies, each of said first group of contact bridge assemblies comprising a first contact bridge and a first spring, said first group of contact bridges made of a conductive material and operatively coupled to said first end of said actuator assembly, said first spring connected to said first contact bridge, the movement of said actuator assembly either driving said first group of contact bridges into contact with a first group of pairs of contact points positioned directly opposite said first group of contact bridges, said first group of contact bridges serving as a first conductive pathway between said first group of pairs of contact points, or driving said first group of contact bridges into breaking contact with said first group of pairs of contact points, each of said first group of pairs of contact points connecting to a first blow-out magnet, the movement of said actuator assembly driven by said relay motor assembly; and a second group of contact bridge assemblies, each of said second group of contact bridge assemblies comprising a second contact bridge and a second spring, said second group of contact bridges made of a conductive material and operatively coupled to said second end of said actuator assembly, said second spring connected to said second contact bridge, the movement of said actuator assembly either driving said second group of contact bridges into contact with a second group of pairs of contact points positioned directly opposite said second group of contact bridges, said second group of contact bridges serving as a second conductive pathway between said second group of pairs of contact points, or driving said second group of contact bridges into breaking contact with said second group of pairs of contact points, each of said second group of pairs of contact points connecting a second blow-out magnet, said second blow-out magnet being identical to said first blow-out magnet, the movement of said actuator assembly driven by said relay motor assembly.

2. The latching magnetic relay assembly in claim 1, wherein each of both said first group of contact bridges and said second group of contact bridges is made of copper and has a width of 10 millimeters and a thickness of 1 millimeter.

3. The latching magnetic relay assembly in claim 1, wherein a plurality of first groups of contact bridge assemblies are operatively coupled to said first end of said actuator assembly, said plurality of first groups of contact bridge assemblies are electrically insulated from one another.

4. The latching magnetic relay assembly in claim 1, wherein a plurality of second groups of contact bridge assemblies are operatively coupled to said second end of said actuator assembly, said plurality of second groups of contact bridge assemblies are electrically insulated from one another.

5. The latching magnetic relay assembly in claim 1, wherein a plurality of first contact buttons are conductively connected to each of said first group of contact bridges.

6. The latching magnetic relay assembly in claim 1, wherein a plurality of second contact buttons are conductively connected to each of said second group of contact bridges.

7. The latching magnetic relay assembly in claim 1 further comprises a housing having a top cover and a bottom cover, a plurality of first contact terminal assemblies and a plurality of second contact terminal assemblies inserted into and extending through walls of said housing, said relay motor assembly, said actuator assembly, said first group of contact bridge assemblies, and said second group of contact bridge assemblies being disposed within said housing, said first contact terminal assembly having said first group of pairs of contact points positioned across said first group of contact bridges, a first gap of at least 1.6 mm separating each of said first group of contact bridges and each of said first pair of contact points, said second contact terminal assembly having said second group of pairs of contact points positioned across said second group of contact bridges, a second gap of at least 1.6 mm separating each of said second group of contact bridges and each of said second pair of contact points.

8. The latching magnetic relay assembly in claim 1, wherein said first group of contact bridges are in breaking contact with said first group of pairs of contact points when said second group of contact bridges are into contact with said second group of pairs of contact points.

9. The latching magnetic relay assembly in claim 1, wherein said second group of contact bridges are in breaking contact with said second group of pairs of contact points when said first group of contact bridges are into contact with said first group of pairs of contact points.

10. A latching magnetic relay assembly comprising:

a relay motor with a first coil bobbin having a first excitation coil wound therearound and a second coil bobbin having a second excitation coil wound therearound, both said first excitation coil and said second excitation coil being identical, said first excitation coil being electrically insulated from said second excitation coil;

an actuator assembly magnetically coupled to both said relay motor, said actuator assembly having a first end and a second end;

a first group of contact bridge assemblies, each of said first group of contact bridge assemblies comprising a first contact bridge and a first spring, said first group of contact bridges made of a conductive material and operatively coupled to said first end of said actuator assembly, said first spring connected to said first contact bridge, the movement of said actuator assembly either driving said first group of contact bridges into contact with a first group of pairs of contact points positioned directly opposite said first group of contact bridges, said first group of contact bridges serving as a first conductive pathway between said first group of pairs of contact points, or driving said first group of contact bridges into breaking contact with said first group of pairs of contact points, each of said first group of pairs of contact points connecting a first blow-out magnet, the movement of said actuator assembly initiated by said relay motor; and a second group of contact bridge assemblies, each of said second group of contact bridge assemblies comprising a second contact bridge and a second spring, said second group of contact bridges made of a conductive material and operatively coupled to said second end of said actuator assembly, said second spring connected to said second contact bridge, the movement of said actuator assembly either driving said second group of contact bridges into contact with a second group of pairs of contact points positioned directly opposite said second group of contact bridges, said second group of contact bridges serving as a second conductive pathway between said second group of pairs of contact points, or driving said second group of contact bridges into breaking contact with said second group of pairs of contact points, each of said second group of pairs of contact points connecting to a second blow-out magnet, said second blow-out magnet being identical to said first blow-out magnet, the movement of said actuator assembly initiated by said relay motor.

11. The latching magnetic relay assembly in claim 10, wherein each of both said first group of contact bridges and said second group of contact bridges is made of copper and has a width of 10 millimeters and a thickness of 1 millimeter.

12. The latching magnetic relay assembly in claim 10, wherein a plurality of first group of contact bridge assemblies are operatively coupled to said first end of said actuator assembly, said plurality of first group of contact bridge assemblies are electrically insulated from one another.

13. The latching magnetic relay assembly in claim 10, wherein a plurality of second group of contact bridge assemblies are operatively coupled to said second end of said actuator assembly, said plurality of second group of contact bridge assemblies are electrically insulated from one another.

14. The latching magnetic relay assembly in claim 10, wherein a plurality of first pairs of contact buttons are conductively connected to each of said first group of contact bridges.

15. The latching magnetic relay assembly in claim 10, wherein a plurality of second pairs of contact buttons are conductively connected to each of said second group of contact bridges.

16. The latching magnetic relay assembly in claim 10 further comprises a housing having a top cover and a bottom cover, a plurality of first contact terminal assemblies and a plurality of second contact terminal assemblies inserted into and extending through walls of said housing, said relay motor assembly, said actuator assembly, said first group of contact bridge assemblies, and said second group of contact bridge assemblies being disposed within said housing, said first contact terminal assemblies having said first group of pairs of contact points positioned across said first group of contact bridges, a first gap of at least 1.6 mm separating each of said first group of contact bridges and each of said first pair of contact points, said second contact terminal assembly having said second group of pairs of contact points positioned across said second group of contact bridges, a second gap of at least 1.6 mm separating each of said second group of contact bridges and each of said second pair of contact points.

17. The latching magnetic relay assembly in claim 10, wherein said first group of contact bridges are in breaking contact with said first group of pairs of contact points when said second group of contact bridges are into contact with said second group of pairs of contact points.

18. The latching magnetic relay assembly in claim 10, wherein said second group of contact bridges are in breaking contact with said second group of pairs of contact points when said first group of contact bridges is into contact with said first group of pairs of contact points.

19. A latching magnetic relay assembly comprising:

a relay motor assembly comprising a first elongated coil bobbin having a first excitation coil wound therearound and a second elongated coil bobbin having a second excitation coil wound therearound, both said first excitation coil and said second excitation coil being identical, said first excitation coil being electrically insulated from said second excitation coil, an axially extending cavity within said first elongated coil bobbin and said second elongated coil bobbin, a first generally J-shaped ferromagnetic frame, said first generally J-shaped ferromagnetic frame having a first plurality of core sections being disposed in and extending through said axially extending cavity in both said first elongated coil bobbin and said second elongated coil bobbin, said first contact section of said first generally J-shaped ferromagnetic frame extending generally parallel to said first plurality of core sections and positioning above said first elongated coil bobbin, a second generally J-shaped ferromagnetic frame, said second generally J-shaped ferromagnetic frame having a second plurality of core sections being disposed in and extending through said axially extending cavity in both said first elongated coil bobbin and said second elongated coil bobbin, said second contact section of said second generally J-shaped ferromagnetic frame extending generally parallel to said second plurality of core sections and positioning above said second elongated coil bobbin, a third generally J-shaped ferromagnetic frame, said third generally J-shaped ferromagnetic frame being same as said second general J-shaped ferromagnetic frame, said third generally J-shaped ferromagnetic frame having a third plurality of core sections being disposed in and extending through said axially extending cavity in both said first elongated coil bobbin and said second elongated coil bobbin, said third contact section of said third generally J-shaped ferromagnetic frame extending generally parallel to said third plurality of core sections and positioning below said first elongated coil bobbin, and a fourth generally J-shaped ferromagnetic frame, said fourth generally J-shaped ferromagnetic frame being same as said first generally J-shaped ferromagnetic frame, said fourth generally J-shaped ferromagnetic frame having a fourth plurality of core sections being disposed in and extending through said axially extending cavity in both said first elongated coil bobbin and said second elongated coil bobbin, said fourth contact section of said fourth generally J-shaped ferromagnetic frame extending generally parallel to said fourth plurality of core sections and positioning below said second elongated coil bobbin;

an actuator assembly comprising an actuator frame operatively coupled to a first generally U-shaped ferromagnetic pole piece and a second generally U-shaped ferromagnetic pole piece, said first generally U-shaped ferromagnetic pole piece and said second generally U-shaped ferromagnetic pole piece being identical, and two permanent magnets, said two permanent magnets being identical, said actuator assembly having a first end and a second end, said first generally U-shaped ferromagnetic pole piece and said second generally U-shaped ferromagnetic pole piece mounted in back-to-back relation, said first generally U-shaped ferromagnetic pole piece having a fifth contact section and a sixth contact section, said second generally U-shaped ferromagnetic pole piece having a seventh contact section and a eighth contact section, said two permanent magnets lying sandwiched therebetween, said actuator assembly positioned so said first contact section and said third contact section being located in between said fifth contact section and said sixth contact section, said second contact section and said fourth contact section being located in between said seventh contact section and said eighth contact section, said first generally U-shaped ferromagnetic pole piece being located in overlapping relation across from said first contact section and said third contact section, said second generally U-shaped ferromagnetic pole piece being located in overlapping relation across from said second contact section and said fourth contact section, said first generally U-shaped ferromagnetic pole piece magnetically coupled to said first general J-shaped ferromagnetic frame when said second generally U-shaped ferromagnetic pole piece magnetically coupled to said second general J-shaped ferromagnetic frame, and said first general U-shaped ferromagnetic pole piece magnetically coupled to said third general J-shaped ferromagnetic frame when said second general U-shaped ferromagnetic pole piece magnetically couple to said fourth general J-shaped ferromagnetic frame;

a first means for conductive contact, said first means for conductive contact operatively coupled to said first end of said actuator assembly, the movement of said actuator assembly either driving said first means for conductive contact into contact with a first pair of contact points positioned directly opposite said first means for conductive contact, said first means for conductive contact acting as a first conductive pathway between said first pair of contact points, or driving said first means for conductive contact into breaking contact with said first pair of contact points, each of said first pair of contact points connecting to a first blow-out magnet, the movement of said actuator assembly initiated by said relay motor assembly; and a second means for conductive contact, said second means for conductive contact operatively coupled to said second end of said actuator assembly, the movement of said actuator assembly either driving said second means for conductive contact into contact with a second pair of contact points positioned directly opposite said second means for conductive contact, said second means for conductive contact acting as a second conductive pathway between said second pair of contact points, or driving said second means for conductive contact into breaking contact with said second pair of contact points, each of said second pair of contact points connecting a second blow-out magnet, said second blow-out magnet being identical to said first blow-out magnet, the movement of said actuator assembly initiated by said relay motor assembly.

20. The latching magnetic relay assembly in claim 19, wherein a plurality of first means for conductive contact are operatively coupled to said first end of said actuator assembly.

21. The latching magnetic relay assembly in claim 19, wherein a plurality of second means for conductive contact are operatively coupled to said second end of said actuator assembly.

22. The latching magnetic relay assembly in claim 19, wherein a plurality of first contact buttons are conductively connected to said first means for conductive contact, said plurality of first contact bridges are electrically insulated from one another, said plurality of first springs are electrically insulated from one another.

23. The latching magnetic relay assembly in claim 19, wherein a plurality of second contact buttons are conductively connected to said second means for conductive contact, said plurality of second contact bridges are electrically insulated from one another, said plurality of second springs are electrically insulated from one another.

24. The latching magnetic relay assembly in claim 19 further comprises a housing having a top cover and a bottom cover, a plurality of first contact terminal assemblies and a plurality of second contact terminal assemblies inserted into and extending through walls of said housing, said relay motor assembly, said actuator assembly, said first means for conductive contact, and said second means for conductive contact being disposed within said housing.

25. The latching magnetic relay in claim 19, wherein said first means for conductive contact is in breaking contact with said first pair of contact points when said second means for conductive contact is into contact with said second pair of contact points.

26. The latching magnetic relay assembly in claim 19, wherein said second means for conductive contact is in breaking contact with said second pair of contact points when said first means for conductive contact is into contact with said first pair of contact points.

27. A latching magnetic relay assembly comprising:

a relay motor with a first coil bobbin having a first excitation coil wound therearound and a second coil bobbin having a second excitation coil wound therearound, both said first excitation coil and said second excitation coil being identical, said first excitation coil being electrically insulated from said second excitation coil;

an actuator assembly magnetically coupled to said relay motor, said actuator assembly having a first end and a second end;

a first means for conductive contact, said first means for conductive contact operatively coupled to said first end of said actuator assembly, the movement of said actuator assembly either driving said first means for conductive contact into contact with a first pair of contact points positioned directly opposite said first means for conductive contact, said first means for conductive contact acting as a first conductive pathway between said first pair of contact points, or driving said first means for conductive contact into breaking contact with said first pair of contact points, each of said first pair of contact points connecting to a first blow-out magnet, the movement of said actuator assembly initiated by said relay motor assembly; and a second means for conductive contact, said second means for conductive contact operatively coupled to said second end of said actuator assembly, the movement of said actuator assembly either driving said second means for conductive contact into contact with a second pair of contact points positioned directly opposite said second means for conductive contact, said second means for conductive contact acting as a second conductive pathway between said second pair of contact points, or driving said second means for conductive contact into breaking contact with said second pair of contact points, each of said second pair of contact points connecting to said second blow-out magnet, said second blow-out magnet being identical to said first blow-out magnet, the movement of said actuator assembly initiated by said relay motor assembly.

28. The latching magnetic relay assembly in claim 27, wherein both said first means for conductive contact and said second means for conductive contact are made of copper and have a width of 10 millimeters and a thickness of 1 millimeter.

29. The latching magnetic relay assembly in claim 27, wherein a plurality of first means for conductive contact are operatively coupled to said first end of said actuator assembly, said plurality of first means for conductive contact are electrically insulated from one another.

30. The latching magnetic relay assembly in claim 27, wherein a plurality of second means for conductive contact are operatively coupled to said second end of said actuator assembly, said plurality of second means for conductive are electrically insulated from one another.

31. The latching magnetic relay assembly in claim 27, wherein a plurality of first pairs of contact buttons are conductively connected to said first means for conductive contact.

32. The latching magnetic relay assembly in claim 27, wherein a plurality of second pairs of contact buttons are conductively connected to said second means for conductive contact.

33. The latching magnetic relay assembly in claim 27 further comprises a housing having a top cover and a bottom cover, a plurality of first contact terminal assemblies and a plurality of second contact terminal assemblies inserted into and extending through walls of said housing, said relay motor, said actuator assembly, said first means for conductive contact, and said second means for conductive contact being disposed within said housing, said first contact terminal assembly having said first pair of contact points positioned across said first means for conductive contact, a first gap of at least 1.6 mm separating said first means for conductive contact and each of said first pair of contact points, said second contact terminal assembly having said second pair of contact points positioned across said second means for conductive contact, a second gap of at least 1.6 mm separating said second means for conductive contact and each of said second pair of contact points.

34. The latching magnetic relay assembly in claim 27, wherein said first means for conductive contact is in breaking contact with said first pair of contact points when said second means for conductive contact is into contact with said second pair of contact points.

35. The latching magnetic relay assembly in claim 27, wherein said second means for conductive contact is in breaking contact with said second pair of contact points when said first means for conductive contact is into contact with said first pair of contact points.

36. A latching magnetic relay assembly comprising:

a relay motor assembly comprising a first coil bobbin having a first excitation coil wound therearound and a second coil bobbin having a second excitation coil wound therearound, said first excitation coil being electrically insulated from said second excitation coil, an axially extending cavity within said first coil bobbin and said second coil bobbin, a first ferromagnetic frame, said first ferromagnetic frame having a first plurality of core sections being disposed in and extending through said axially extending cavity in both said first coil bobbin and said second coil bobbin, said first contact section of said first ferromagnetic frame extending and positioning above said first coil bobbin, a second ferromagnetic frame, said second ferromagnetic frame having a second plurality of core sections being disposed in and extending through said axially extending cavity in both said first coil bobbin and said second coil bobbin, said second contact section of said second ferromagnetic frame extending and positioning above said second coil bobbin, a third ferromagnetic frame, said third ferromagnetic frame being same as said second ferromagnetic frame, said third ferromagnetic frame having a third plurality of core sections being disposed in and extending through said axially extending cavity in both said first coil bobbin and said second coil bobbin, said third contact section of said third ferromagnetic frame extending and positioning below said first coil bobbin, and a fourth ferromagnetic frame, said fourth ferromagnetic frame being same as said first ferromagnetic frame, said fourth ferromagnetic frame having a fourth plurality of core sections being disposed in and extending through said axially extending cavity in both said first coil bobbin and said second coil bobbin, said fourth contact section of said fourth ferromagnetic frame extending and positioning below said second coil bobbin;

an actuator assembly comprising an actuator frame operatively coupled to a first ferromagnetic pole piece and a second ferromagnetic pole piece, said first ferromagnetic pole piece and said second ferromagnetic pole piece being identical, and two permanent magnets, said two permanent magnets being identical, said actuator assembly having a first end and a second end, said first ferromagnetic pole piece and said second ferromagnetic pole piece mounted in back-to-back relation, said first ferromagnetic pole piece having a fifth contact section and a sixth contact section, said second ferromagnetic pole piece having a seventh contact section and a eighth contact section, said two permanent magnets lying sandwiched therebetween, said actuator assembly positioned so said first contact section and said third contact section being located in between said fifth contact section and said sixth contact section, said second contact section and said fourth contact section being located in between said seventh contact section and said eighth contact section, said first ferromagnetic pole piece being located in overlapping relation across from said first contact section and said third contact section, said second ferromagnetic pole piece being located in overlapping relation across from said second contact section and said fourth contact section, said first ferromagnetic pole piece magnetically coupled to said first ferromagnetic frame when said second ferromagnetic pole piece magnetically coupled to said second ferromagnetic frame, and said first ferromagnetic pole piece magnetically coupled to said third ferromagnetic frame when said second ferromagnetic pole piece magnetically couple to said fourth ferromagnetic frame;

a first group of contact bridge assemblies, each of said first group of contact bridge assemblies comprising a first contact bridge and a first spring, said first group of contact bridges made of a conductive material and operatively coupled to said first end of said actuator assembly, said first spring connected to said first contact bridge, the movement of said actuator assembly either driving said first group of contact bridges into contact with a first group of pairs of contact points positioned directly opposite said first group of contact bridges, said first group of contact bridges serving as a first conductive pathway between said first group of pairs of contact points, or driving said first group of contact bridges into breaking contact with said first group of pairs of contact points, each of said first group of pairs of contact points connecting to a first blow-out magnet, the movement of said actuator assembly driven by said relay motor assembly; and a second group of contact bridge assemblies, each of said second group of contact bridge assemblies comprising a second contact bridges and a second spring, said second group of contact bridges made of a conductive material and operatively coupled to said second end of said actuator assembly, said second spring connected to said second contact bridge, the movement of said actuator assembly either driving said second group of contact bridges into contact with a second group of pairs of contact points positioned directly opposite said second group of contact bridges, said second group of contact bridges serving as a second conductive pathway between said second group of pairs of contact points, or driving said second group of contact bridges into breaking contact with said second group of pairs of contact points, each of said second group of pairs of contact points connecting to a second blow-out magnet, said second blow-out magnet being identical to said first blow-out magnet, the movement of said actuator assembly driven by said relay motor assembly.

37. The latching magnetic relay assembly in claim 36, wherein each of both said first group of contact bridges and said second group of contact bridges is made of copper and has a width of 10 millimeters and a thickness of 1 millimeter.

38. The latching magnetic relay assembly in claim 36, wherein a plurality of said first group of contact bridge assemblies are operatively coupled to said first end of said actuator assembly, said plurality of first group of contact bridge assemblies are electrically insulated from one another.

39. The latching magnetic relay assembly in claim 36, wherein a plurality of second group of contact bridge assemblies are operatively coupled to said second end of said actuator assembly, said plurality of second group of contact bridge assemblies are electrically insulated from one another.

40. The latching magnetic relay assembly in claim 36, wherein a plurality of said first contact buttons are conductively connected to each of said first group of contact bridges.

41. The latching magnetic relay assembly in claim 36, wherein a plurality of second contact buttons are conductively connected to each of said second group of contact bridges.

42. The latching magnetic relay assembly in claim 36 further comprises a housing having a top cover and a bottom cover, a plurality of first contact terminal assemblies and a plurality of second contact terminal assemblies inserted into and extending through walls of said housing, said relay motor assembly, said actuator assembly, said first group of contact bridge assemblies, and said second group of contact bridge assemblies being disposed within said housing, said first contact terminal assembly having said first group of pairs of contact points positioned across said first group of contact bridges, a first gap of at least 1.6 mm separating each of said first group of contact bridges and each of said first group of pairs of contact points, said second contact terminal assembly having said second group of pairs of contact points positioned across said second group of contact bridges, a second gap of at least 1.6 mm separating each of said second group of contact bridges and each of said second group of pairs of contact points.

43. The latching magnetic relay assembly in claim 36, wherein said first group of contact bridges are in breaking contact with said first group of pairs of contact points when said second group of contact bridges are in breaking contact with said second group of pairs of contact points.

44. The latching magnetic relay assembly in claim 36, wherein said first group of contact bridges are into contact with said first group of pairs of contact points when said second group of contact bridges are into contact with said second group of pairs of contact points.

45. A latching magnetic relay assembly comprising:

a relay motor with a first coil bobbin having a first excitation coil wound therearound and a second coil bobbin having a second excitation coil wound therearound, said first excitation coil being electrically insulated from said second excitation coil;

an actuator assembly magnetically coupled to both said relay motor, said actuator assembly having a first end and a second end;

a first group of contact bridge assemblies, each of said first group of contact bridge assemblies comprising a first contact bridge and a first spring, said first group of contact bridges made of a conductive material and operatively coupled to said first end of said actuator assembly, each of said first group of contact bridges having a plurality of first pairs of contact buttons, said first pairs of contact buttons being conductively connected to each of said first group of contact bridges, each of said first group of contact bridges being made of copper and having a width of 10 millimeters and a thickness of 1 millimeter, said first spring connected to said first contact bridge, the movement of said actuator assembly either driving said first group of contact bridges into contact with a first group of pairs of contact points positioned directly opposite said first group of contact bridges, said first group of contact bridges serving as a first conductive pathway between said first group of pairs of contact points, or driving said first group of contact bridges into breaking contact with said first group of pairs of contact points, each of said first group of pairs of contact points connecting to a first blow-out magnet, the movement of said actuator assembly initiated by said relay motor; and a second group of contact bridge assemblies, said second group of contact bridge assemblies comprising a second group of contact bridge and a second spring, said second group of contact bridges made of a conductive material and operatively coupled to said second end of said actuator assembly, each of said second group of contact bridges having a plurality of second pairs of contact buttons, said second pairs of contact buttons being conductively connected to each of said second group of contact bridges, each of said second group of contact bridges being made of copper and having a width of 10 millimeters and a thickness of 1 millimeter, said second spring connected to said second contact bridge, the movement of said actuator assembly either driving said second group of contact bridges into contact with a second group of pairs of contact points positioned directly opposite said second group of contact bridges, said second group of contact bridges serving as a second conductive pathway between said second group of pairs of contact points, or driving said second group of contact bridges into breaking contact with said second group of pairs of contact points, each of said second group of pairs of contact points connecting to a second blow-out magnet, said second blow-out magnet being identical to said first blow-out magnet, the movement of said actuator assembly initiated by said relay motor.

46. The latching magnetic relay assembly in claim 45, wherein a plurality of said first group of contact bridge assemblies are operatively coupled to said first end of said actuator assembly, said plurality of first contact bridge assemblies are electrically insulated from one another.

47. The latching magnetic relay assembly in claim 45, wherein a plurality of second group of contact bridge assemblies are operatively coupled to said second end of said actuator assembly, said plurality of second group of contact bridge assemblies are electrically insulated from one another.

48. The latching magnetic relay assembly in claim 45 further comprises a housing having a top cover and a bottom cover, a plurality of first contact terminal assemblies and a plurality of second contact terminal assemblies inserted into and extending through walls of said housing, said relay motor, said actuator assembly, said first group of contact bridge assemblies, and said second group of contact bridge assemblies being disposed within said housing, said first contact terminal assembly having said first group of pairs of contact points positioned across said first group of contact bridges, a first gap of at least 1.6 mm separating each of said first contact bridge and each of said first group of pairs of contact points, said second contact terminal assembly having said second group of pairs of contact points positioned across said second group of contact bridges, a second gap of at least 1.6 mm separating each of said second group of contact bridge and each of said second group of pairs of contact points.

49. The latching magnetic relay assembly in claim 45, wherein said first group of contact bridges are in breaking contact with said first group of pairs of contact points when said second group of contact bridges are in breaking contact with said second group of pairs of contact points.

50. The latching magnetic relay assembly in claim 45, wherein said first group of contact bridges are into contact with said first group of pairs of contact points when said second group of contact bridges are into contact with said second group of pairs of contact points.

51. A latching magnetic relay assembly comprising:

a relay motor assembly comprising a first coil bobbin having a first excitation coil wound therearound and a second coil bobbin having a second excitation coil wound therearound, said first excitation coil being electrically insulated from said second excitation coil, an axially extending cavity within said first coil bobbin and said second coil bobbin, a first ferromagnetic frame, said first ferromagnetic frame having a first plurality of core sections being disposed in and extending through said axially extending cavity in both said first coil bobbin and said second coil bobbin, said first contact section of said first ferromagnetic frame extending and positioning above said first coil bobbin, a second ferromagnetic frame, said second ferromagnetic frame having a second plurality of core sections being disposed in and extending through said axially extending cavity in both said first coil bobbin and said second coil bobbin, said second contact section of said second ferromagnetic frame extending and positioning above said second coil bobbin, a third ferromagnetic frame, said third ferromagnetic frame being same as said second ferromagnetic frame, said third ferromagnetic frame having a third plurality of core sections being disposed in and extending through said axially extending cavity in both said first coil bobbin and said second coil bobbin, said third contact section of said third ferromagnetic frame extending and positioning below said first coil bobbin, and a fourth ferromagnetic frame, said fourth ferromagnetic frame being same as said first ferromagnetic frame, said fourth ferromagnetic frame having a fourth plurality of core sections being disposed in and extending through said axially extending cavity in both said first coil bobbin and said second coil bobbin, said fourth contact section of said fourth ferromagnetic frame extending and positioning below said second elongated coil bobbin;

an actuator assembly comprising an actuator frame operatively coupled to a first ferromagnetic pole piece and a second ferromagnetic pole piece, said first ferromagnetic pole piece and said second ferromagnetic pole piece being identical, and two permanent magnets, said two permanent magnets being identical, said actuator assembly having a first end and a second end, said first ferromagnetic pole piece and said second ferromagnetic pole piece mounted in back-to-back relation, said first ferromagnetic pole piece having a fifth contact section and a sixth contact section, said second ferromagnetic pole piece having a seventh contact section and a eighth contact section, said two permanent magnets lying sandwiched therebetween, said actuator assembly positioned so said first contact section and said third contact section being located in between said fifth contact section and said sixth contact section, said second contact section and said fourth contact section being located in between said seventh contact section and said eighth contact section, said first ferromagnetic pole piece being located in overlapping relation across from said first contact section and said third contact section, said second ferromagnetic pole piece being located in overlapping relation across from said second contact section and said fourth contact section, said first ferromagnetic pole piece magnetically coupled to said first ferromagnetic frame when said second ferromagnetic pole piece magnetically coupled to said second ferromagnetic frame, and said first ferromagnetic pole piece magnetically coupled to said third ferromagnetic frame when said second ferromagnetic pole piece magnetically couple to said fourth ferromagnetic frame;

a first means for conductive contact, said first means for conductive contact operatively coupled to said first end of said actuator assembly, the movement of said actuator assembly either driving said first means for conductive contact into contact with a first pair of contact points positioned directly opposite said first means for conductive contact, said first means for conductive contact acting as a first conductive pathway between said first pair of contact points, or driving said first means for conductive contact into breaking contact with said first pair of contact points, each of said first pair of contact points connecting to a first blow-out magnet, the movement of said actuator assembly initiated by said relay motor assembly; and a second means for conductive contact, said second means for conductive contact operatively coupled to said second end of said actuator assembly, the movement of said actuator assembly either driving said second means for conductive contact into contact with a second pair of contact points positioned directly opposite said second means for conductive contact, said second means for conductive contact acting as a second conductive pathway between said second pair of contact points, or driving said second means for conductive contact into breaking contact with said second pair of contact points, each of said second pair of contact points connecting to a second blow-out magnet, said second blow-out magnet being identical to said first blow-out magnet, the movement of said actuator assembly initiated by said relay motor assembly.

52. The latching magnetic relay assembly in claim 51, wherein a plurality of first means for conductive contact are operatively coupled to said first end of said actuator assembly, said plurality of first means for conductive contact are electrically insulated from one another.

53. The latching magnetic relay assembly in claim 51, wherein a plurality of second means for conductive contact are operatively coupled to said second end of said actuator assembly, said plurality of second means for conductive contact are electrically insulated from one another.

54. The latching magnetic relay assembly in claim 51, wherein a plurality of first contact buttons are conductively connected to said first means for conductive contact.

55. The latching magnetic relay assembly in claim 51, wherein a plurality of second contact buttons are conductively connected to said second means for conductive contact.

56. The latching magnetic relay assembly in claim 51 further comprises a housing having a top cover and a bottom cover, a plurality of first contact terminal assemblies and a plurality of second contact terminal assemblies inserted into and extending through walls of said housing, said relay motor assembly, said actuator assembly, said first means for conductive contact, and said second means for conductive contact being disposed within said housing.

57. The latching magnetic relay assembly in claim 51, wherein said first contact means for conductive contact is in breaking contact with said first pair of contact points when said second contact means for conductive contact is in breaking contact with said second pair of contact points.

58. The latching magnetic relay assembly in claim 51, wherein said first contact means for conductive contact is into contact with said first pair of contact points when said second contact means for conductive contact is into contact with said second pair of contact points.

59. A latching magnetic relay assembly comprising:

a relay motor with a first coil bobbin having a first excitation coil wound therearound and a second coil bobbin having a second excitation coil wound therearound, said first excitation coil being electrically insulated from said second excitation coil;

an actuator assembly magnetically coupled to said relay motor, said actuator assembly having a first end and a second end;

a first means for conductive contact, said first means for conductive contact having a plurality of first pairs of contact buttons, said first pairs of contact buttons being conductively connected to said first means for conductive contact, said first means for conductive contact being made of copper and having a width of 10 millimeters and a thickness of 1 millimeter, said first means for conductive contact operatively coupled to said first end of said actuator assembly, the movement of said actuator assembly either driving said first means for conductive contact into contact with a first pair of contact points positioned directly opposite said first means for conductive contact, said first means for conductive contact acting as a first conductive pathway between said first pair of contact points, or driving said first means for conductive contact into breaking contact with said first pair of contact points, each of said first pair of contact points connecting to a first blow-out magnet, the movement of said actuator assembly initiated by said relay motor assembly; and a second means for conductive contact, said second means for conductive contact having a plurality of second pairs of contact buttons, said second pairs of contact buttons being conductively connected to said second means for conductive contact, said second means for conductive contact being made of copper and having a width of 10 millimeters and a thickness of 1 millimeter, said second means for conductive contact operatively coupled to said second end of said actuator assembly, the movement of said actuator assembly either driving said second means for conductive contact into contact with a second pair of contact points positioned directly opposite said second means for conductive contact, said second means for conductive contact acting as a second conductive pathway between said second pair of contact points, or driving said second means for conductive contact into breaking contact with said second pair of contact points, each of said second pair of contact points connecting to a second blow-out magnet, said second blow-out magnet being identical to said first blow-out magnet, the movement of said actuator assembly initiated by said relay motor assembly.

60. The latching magnetic relay assembly in claim 59, wherein a plurality of first means for conductive contact are operatively coupled to said first end of said actuator assembly, said plurality of first means for conductive contact are electrically insulated from one another.

61. The latching magnetic relay assembly in claim 59, wherein a plurality of second means for conductive contact are operatively coupled to said second end of said actuator assembly, said plurality of second means for conductive contact are electrically insulated from one another.

62. The latching magnetic relay assembly in claim 59, wherein a plurality of first pairs of contact buttons are conductively connected to said first means for conductive contact.

63. The latching magnetic relay assembly in claim 59, wherein said first contact means for conductive contact is in breaking contact with said first pair of contact points when said second contact means for conductive contact is in breaking contact with said second pair of contact points.

64. The latching magnetic relay assembly in claim 59, wherein said first contact means for conductive contact is into contact with said first pair of contact points when said second contact means for conductive contact is into contact with said second pair of contact points.

65. A latching magnetic relay assembly comprising:

a relay motor assembly comprising a first elongated coil bobbin having a first excitation coil wound therearound and a second elongated coil bobbin having a second excitation coil wound therearound, both said first excitation coil and said second excitation coil being identical, said first excitation coil being electrically insulated from said second excitation coil, an axially extending cavity within said first elongated coil bobbin and said second elongated coil bobbin, a first generally J-shaped ferromagnetic frame, said first generally J-shaped ferromagnetic frame having a first plurality of core sections being disposed in and extending through said axially extending cavity in both said first elongated coil bobbin and said second elongated coil bobbin, said first contact section of said first generally J-shaped ferromagnetic frame extending generally parallel to said first plurality of core sections and positioning above said first elongated coil bobbin, a second generally J-shaped ferromagnetic frame, said second generally J-shaped ferromagnetic frame having a second plurality of core sections being disposed in and extending through said axially extending cavity in both said first elongated coil bobbin and said second elongated coil bobbin, said second contact section of said second generally J-shaped ferromagnetic frame extending generally parallel to said second plurality of core sections and positioning above said second elongated coil bobbin, a third generally J-shaped ferromagnetic frame, said third generally J-shaped ferromagnetic frame being same as said second generally J-shaped ferromagnetic frame, said third generally J-shaped ferromagnetic frame having a third plurality of core sections being disposed in and extending through said axially extending cavity in both said first elongated coil bobbin and said second elongated coil bobbin, said third contact section of said third generally J-shaped ferromagnetic frame extending generally parallel to said third plurality of core sections and positioning below said first elongated coil bobbin, and a fourth generally J-shaped ferromagnetic frame, said fourth generally J-shaped ferromagnetic frame being same as said first generally J-shaped ferromagnetic frame, said fourth generally J-shaped ferromagnetic frame having a fourth plurality of core sections being disposed in and extending through said axially extending cavity in both said first elongated coil bobbin and said second elongated coil bobbin, said fourth contact section of said fourth generally J-shaped ferromagnetic frame extending generally parallel to said fourth plurality of core sections and positioning below said second elongated coil bobbin;

an actuator assembly comprising an actuator frame operatively coupled to a first generally U-shaped ferromagnetic pole piece and a second generally U-shaped ferromagnetic pole piece, said first generally U-shaped ferromagnetic pole piece and said second generally U-shaped ferromagnetic pole piece being identical, and two permanent magnets, said two permanent magnets being identical, said actuator assembly having a first end and a second end, said first generally U-shaped ferromagnetic pole piece and said second generally U-shaped ferromagnetic pole piece mounted in back-to-back relation, said first generally U-shaped ferromagnetic pole piece having a fifth contact section and a sixth contact section, said second generally U-shaped ferromagnetic pole piece having a seventh contact section and a eighth contact section, said two permanent magnets lying sandwiched therebetween, said actuator assembly positioned so said first contact section and said third contact section being located in between said fifth contact section and said sixth contact section, said second contact section and said fourth contact section being located in between said seventh contact section and said eighth contact section, said first generally U-shaped ferromagnetic pole piece being located in overlapping relation across from said first contact section and said third contact section, said second generally U-shaped ferromagnetic pole piece being located in overlapping relation across from said second contact section and said fourth contact section, said first generally U-shaped ferromagnetic pole piece magnetically coupled to said first general J-shaped ferromagnetic frame when said second generally U-shaped ferromagnetic pole piece magnetically coupled to said second general J-shaped ferromagnetic frame, and said first general U-shaped ferromagnetic pole piece magnetically coupled to said third general J-shaped ferromagnetic frame when said second general U-shaped ferromagnetic pole piece magnetically couple to said fourth general J-shaped ferromagnetic frame; and a group of contact bridge assemblies, each of said group of contact bridge assemblies comprising a contact bridge and a spring, said group of contact bridges made of a conductive material and operatively coupled to said first end of said actuator assembly, said spring connected to said contact bridge, the movement of said actuator assembly either driving said group of contact bridges into contact with a group of pairs of contact points positioned directly opposite said group of contact bridges, said group of contact bridges serving as a conductive pathway between said group of pairs of contact points, or driving said group of contact bridges into breaking contact with said group of pairs of contact points, each of said group of pairs of contact points connecting to a blow-out magnet, the movement of said actuator assembly driven by said relay motor assembly.

66. The latching magnetic relay assembly in claim 65, wherein each of said group of contact bridges is made of copper and has a width of 10 millimeters and a thickness of 1 millimeter.

67. The latching magnetic relay assembly in claim 65, wherein a plurality of said group of contact bridge assemblies are operatively coupled to said first end of said actuator assembly, said plurality of said group contact bridge assemblies are electrically insulated from one another.

68. The latching magnetic relay assembly in claim 65, wherein a plurality of contact buttons are conductively connected to each of said group of contact bridges.

69. The latching magnetic relay assembly in claim 65 further comprises a housing having a top cover and a bottom cover, and a plurality of contact terminal assemblies inserted into and extending through walls of said housing, said relay motor assembly, said actuator assembly and said group of contact bridge assemblies being disposed within said housing, said contact terminal assembly having said group of pairs of contact points positioned across said group of contact bridges, a gap of at least 1.6 mm separating each of said group of contact bridges and each of said pair of contact points.

70. The latching magnetic relay assembly in claim 65, wherein said group of contact bridges are into contact with said group of pairs of contact points when said sixth contact section is into contact with said third contact section and said eighth contact section is into contact with said fourth contact section.

71. The latching magnetic relay assembly in claim 65, wherein said group of contact bridges are in breaking contact with said group of pairs of contact points when said sixth contact section is in breaking contact with said third contact section and said eighth contact section is in breaking contact with said fourth contact section.

72. A latching magnetic relay assembly comprising:

a relay motor with a first coil bobbin having a first excitation coil wound therearound and a second coil bobbin having a second excitation coil wound therearound, said first excitation coil being electrically insulated from said second excitation coil;

an actuator assembly magnetically coupled to both said relay motor, said actuator assembly having a first end and a second end; and a group of contact bridge assemblies, each of said group of contact bridge assemblies comprising a contact bridge and a spring, said group of contact bridges having a width of 10 millimeters and a thickness of 1 millimeter, said group of contact bridges being made of copper and operatively coupled to said first end of said actuator assembly, the movement of said actuator assembly either driving said group of contact bridges into contact with a group of pairs of contact points positioned directly opposite said group of contact bridges, each of said group of contact bridges having a plurality of pairs of contact buttons, said plurality of pairs of contact buttons being conductively connected to each of said group of contact bridges, said group of contact bridges serving as a conductive pathway between said group of pairs of contact points, or driving said group of contact bridges into breaking contact with said group of pairs of contact points, each of said group of pairs of contact points connecting to a blow-out magnet, the movement of said actuator assembly initiated by said relay motor.

73. The latching magnetic relay assembly in claim 72, wherein a plurality of said group of contact bridge assemblies are operatively coupled to said first end of said actuator assembly, said plurality of group of contact bridge assemblies are electrically insulated from one another.

74. The latching magnetic relay assembly in claim 72 further comprises a housing having a top cover and a bottom cover, and a plurality of contact terminal assemblies inserted into and extending through walls of said housing, said relay motor, said actuator assembly and said group of contact bridge assemblies being disposed within said housing, said contact terminal assembly having said group of pairs of contact points positioned across said group of contact bridges, a gap of at least 1.6 mm separating each of said group of contact bridges and each of said pair of contact points.

75. A latching magnetic relay assembly comprising:

a relay motor assembly comprising a first elongated coil bobbin having a first excitation coil wound therearound and a second elongated coil bobbin having a second excitation coil wound therearound, both said first excitation coil and said second excitation coil being identical, said first excitation coil being electrically insulated from said second excitation coil, an axially extending cavity within said first elongated coil bobbin and said second elongated coil bobbin, a first generally J-shaped ferromagnetic frame, said first generally J-shaped ferromagnetic frame having a first plurality of core sections being disposed in and extending through said axially extending cavity in both said first elongated coil bobbin and said second elongated coil bobbin, said first contact section of said first generally J-shaped ferromagnetic frame extending generally parallel to said first plurality of core sections and positioning above said first elongated coil bobbin, a second generally J-shaped ferromagnetic frame, said second generally J-shaped ferromagnetic frame having a second plurality of core sections being disposed in and extending through said axially extending cavity in both said first elongated coil bobbin and said second elongated coil bobbin, said second contact section of said second generally J-shaped ferromagnetic frame extending generally parallel to said second plurality of core sections and positioning above said second elongated coil bobbin, a third generally J-shaped ferromagnetic frame, said third generally J-shaped ferromagnetic frame being same as said second generally J-shaped ferromagnetic frame, said third generally J-shaped ferromagnetic frame having a third plurality of core sections being disposed in and extending through said axially extending cavity in both said first elongated coil bobbin and said second elongated coil bobbin, said third contact section of said third generally J-shaped ferromagnetic frame extending generally parallel to said third plurality of core sections and positioning below said first elongated coil bobbin, and a fourth generally J-shaped ferromagnetic frame, said fourth generally J-shaped ferromagnetic frame being same as said first generally J-shaped ferromagnetic frame, said fourth generally J-shaped ferromagnetic frame having a fourth plurality of core sections being disposed in and extending through said axially extending cavity in both said first elongated coil bobbin and said second elongated coil bobbin, said fourth contact section of said fourth generally J-shaped ferromagnetic frame extending generally parallel to said fourth plurality of core sections and positioning below said second elongated coil bobbin;

an actuator assembly comprising an actuator frame operatively coupled to a first generally U-shaped ferromagnetic pole piece and a second generally U-shaped ferromagnetic pole piece, said first generally U-shaped ferromagnetic pole piece and said second generally U-shaped ferromagnetic pole piece being identical, and two permanent magnets, said two permanent magnets being identical, said actuator assembly having a first end and a second end, said first generally U-shaped ferromagnetic pole piece and said second generally U-shaped ferromagnetic pole piece mounted in back-to-back relation, said first generally U-shaped ferromagnetic pole piece having a fifth contact section and a sixth contact section, said second generally U-shaped ferromagnetic pole piece having a seventh contact section and a eighth contact section, said two permanent magnets lying sandwiched therebetween, said actuator assembly positioned so said first contact section and said third contact section being located in between said fifth contact section and said sixth contact section, said second contact section and said fourth contact section being located in between said seventh contact section and said eighth contact section, said first generally U-shaped ferromagnetic pole piece being located in overlapping relation across from said first contact section and said third contact section, said second generally U-shaped ferromagnetic pole piece being located in overlapping relation across from said second contact section and said fourth contact section, said first generally U-shaped ferromagnetic pole piece magnetically coupled to said first general J-shaped ferromagnetic frame when said second generally U-shaped ferromagnetic pole piece magnetically coupled to said second general J-shaped ferromagnetic frame, and said first general U-shaped ferromagnetic pole piece magnetically coupled to said third general J-shaped ferromagnetic frame when said second general U-shaped ferromagnetic pole piece magnetically couple to said fourth general J-shaped ferromagnetic frame; and a means for conductive contact, said means for conductive contact operatively coupled to said first end of said actuator assembly, the movement of said actuator assembly either driving said means for conductive contact into contact with a pair of contact points positioned directly opposite said means for conductive contact, said means for conductive contact acting as a conductive pathway between said pair of contact points, or driving said means for conductive contact into breaking contact with said pair of contact points, each of said pair of contact points connecting to a blow-out magnet, the movement of said actuator assembly initiated by said relay motor assembly.

76. The latching magnetic relay assembly in claim 75, wherein a plurality of means for conductive contact are operatively coupled to said first end of said actuator assembly, said plurality of means for conductive contact being electrically insulated from one another.

77. The latching magnetic relay assembly in claim 75, wherein a plurality of contact buttons are conductively connected to said means for conductive contact.

78. The latching magnetic relay assembly in claim 75 further comprises a housing having a top cover and a bottom cover, and a plurality of contact terminal assemblies inserted into and extending through walls of said housing, said relay motor assembly, said actuator assembly and said means for conductive contact being disposed within said housing.

79. A latching magnetic relay assembly comprising:

a relay motor with a first coil bobbin having a first excitation coil wound therearound and a second coil bobbin having a second excitation coil wound therearound, said first excitation coil being electrically insulated from said second excitation coil;

an actuator assembly magnetically coupled to both said relay motor, said actuator assembly having a first end and a second end;

a first group of contact bridge assemblies, each of said first group of contact bridge assemblies comprising a first contact bridge and a first spring, said first group of contact bridges made of a conductive material and operatively coupled to said first end of said actuator assembly, each of said first group of contact bridges having a width of 10 millimeters and a thickness of 1 millimeter, said first spring connected to said first contact bridge, the movement of said actuator assembly either driving said first group of contact bridges into contact with a first group of pairs of contact points positioned directly opposite said first group of contact bridges, said first group of contact bridges serving as a first conductive pathway between said first group of pairs of contact points, or driving said first group of contact bridges into breaking contact with said first group of pairs of contact points, each of said first group of pairs of contact points connecting a first blow-out magnet, the movement of said actuator assembly initiated by said relay motor; and a second group of contact bridge assemblies, each of said second group of contact bridge assemblies comprising a second contact bridge and a second spring, said second group of contact bridges made of a conductive material and operatively coupled to said second end of said actuator assembly, each of said second group of contact bridges having a width of 10 millimeters and a thickness of 1 millimeter, said second spring connected to said second contact bridge, the movement of said actuator assembly either driving said second group of contact bridges into contact with a second group of pairs of contact points positioned directly opposite said second group of contact bridges, said second group of contact bridges serving as a second conductive pathway between said second group of pairs of contact points, or driving said second group of contact bridges into breaking contact with said second group of pairs of contact points, each of said second group of pairs of contact points connecting to a second blow-out magnet, said second blow-out magnet being identical to said first blow-out magnet, the movement of said actuator assembly initiated by said relay motor.

80. The latching magnetic relay assembly in claim 79, further comprising a housing, a plurality of first contact terminal assemblies and a plurality of second contact terminal assemblies inserted into and extending through said housing, said relay motor assembly, said actuator assembly, said first group of contact bridge assemblies, and said second group of contact bridge assemblies being disposed within said housing, said first contact terminal assemblies having said first group of pairs of contact points positioned across said first group of contact bridges, a first gap separating each of said first group of contact bridges and each of said first pair of contact points, said second contact terminal assembly having said second group of pairs of contact points positioned across said second group of contact bridges, a second gap of separating each of said second group of contact bridges and each of said second pair of contact points.

81. The latching magnetic relay assembly in claim 80, wherein a plurality of first group of contact bridge assemblies are operatively coupled to said first end of said actuator assembly, said plurality of first group of contact bridge assemblies are electrically insulated from one another.

82. The latching magnetic relay assembly in claim 81, wherein a plurality of first pairs of contact buttons are conductively connected to each of said first group of contact bridges.

83. The latching magnetic relay in claim 82, wherein said first group of contact bridges are in breaking contact with said first group of pairs of contact points when said second group of contact bridges are into contact with said second group of pairs of contact points.

84. The latching magnetic relay assembly in claim 83, wherein said second group of contact bridges are in breaking contact with said second group of pairs of contact points when said first group of contact bridges is into contact with said first group of pairs of contact points.

85. The latching magnetic relay assembly in claim 84, wherein a plurality of second group of contact bridge assemblies are operatively coupled to said second end of said actuator assembly, said plurality of second group of contact bridge assemblies are electrically insulated from one another.

86. The latching magnetic relay assembly in claim 85, wherein a plurality of second pairs of contact buttons are conductively connected to each of said second group of contact bridges.

87. A latching magnetic relay assembly comprising:

a relay motor assembly comprising a first coil bobbin having a first excitation coil wound therearound and a second coil bobbin having a second excitation coil wound therearound, said first excitation coil being electrically insulated from said second excitation coil, an axially extending cavity within said first coil bobbin and said second coil bobbin, a first ferromagnetic frame, said first ferromagnetic frame having a first plurality of core sections being disposed in and extending through said axially extending cavity in both said first coil bobbin and said second coil bobbin, said first contact section of said first ferromagnetic frame extending generally parallel to said first plurality of core sections and positioning above said first coil bobbin, a second ferromagnetic frame, said second ferromagnetic frame having a second plurality of core sections being disposed in and extending through said axially extending cavity in both said first coil bobbin and said second coil bobbin, said second contact section of said second ferromagnetic frame extending generally parallel to said second plurality of core sections and positioning above said second coil bobbin, a third ferromagnetic frame, said third ferromagnetic frame being same as said second ferromagnetic frame, said third ferromagnetic frame having a third plurality of core sections being disposed in and extending through said axially extending cavity in both said first coil bobbin and said second coil bobbin, said third contact section of said third ferromagnetic frame extending generally parallel to said third plurality of core sections and positioning below said first coil bobbin, and a fourth ferromagnetic frame, said fourth ferromagnetic frame being same as said first ferromagnetic frame, said fourth ferromagnetic frame having a fourth plurality of core sections being disposed in and extending through said axially extending cavity in both said first coil bobbin and said second coil bobbin, said fourth contact section of said fourth ferromagnetic frame extending generally parallel to said fourth plurality of core sections and positioning below said second coil bobbin;

an actuator assembly comprising an actuator frame operatively coupled to a first ferromagnetic pole piece and a second ferromagnetic pole piece, and two permanent magnets, said actuator assembly having a first end and a second end, said first ferromagnetic pole piece and said second ferromagnetic pole piece mounted in back-to-back relation, said first ferromagnetic pole piece having a fifth contact section and a sixth contact section, said second ferromagnetic pole piece having a seventh contact section and a eighth contact section, said two permanent magnets lying sandwiched therebetween, said actuator assembly positioned so said first contact section and said third contact section being located in between said fifth contact section and said sixth contact section, said second contact section and said fourth contact section being located in between said seventh contact section and said eighth contact section, said first ferromagnetic pole piece being located in overlapping relation across from said first contact section and said third contact section, said second ferromagnetic pole piece being located in overlapping relation across from said second contact section and said fourth contact section, said first ferromagnetic pole piece magnetically coupled to said first ferromagnetic frame when said second ferromagnetic pole piece magnetically coupled to said second ferromagnetic frame, and said first ferromagnetic pole piece magnetically coupled to said third ferromagnetic frame when said second ferromagnetic pole piece magnetically couple to said fourth ferromagnetic frame; and a means for conductive contact, said means for conductive contact operatively coupled to said first end of said actuator assembly, the movement of said actuator assembly either driving said means for conductive contact into contact with a pair of contact points positioned directly opposite said means for conductive contact, said means for conductive contact acting as a conductive pathway between said pair of contact points, or driving said means for conductive contact into breaking contact with said pair of contact points, each of said pair of contact points connecting to a blow-out magnet, the movement of said actuator assembly initiated by said relay motor assembly.

88. The latching magnetic relay in claim 87, further comprises a housing, a plurality of contact terminal assemblies inserted into and extending through said housing, said relay motor assembly, said actuator assembly and said means for conductive contact being disposed within said housing.

89. The latching magnetic relay assembly in claim 88, wherein each of both said first group of contact bridges and said second group of contact bridges is made of copper and has a width of 10 millimeters and a thickness of 1 millimeter.

90. The latching magnetic relay assembly in claim 89, wherein a plurality of first group of contact bridge assemblies are operatively coupled to said first end of said actuator assembly, said plurality of first group of contact bridge assemblies are electrically insulated from one another.

91. The latching magnetic relay assembly in claim 90, wherein said means for conductive contact is in breaking contact with said pair of contact points when said sixth contact section is in breaking contact with said third contact section and said eighth contact section is in breaking contact with said fourth contact section.

92. The latching magnetic relay assembly in claim 91, wherein a plurality of means for conductive contact are operatively coupled to said first end of said actuator assembly, said plurality of means for conductive contact being electrically insulated from one another.

93. A latching magnetic relay assembly comprising:

a relay motor assembly comprising a first elongated coil bobbin having a first excitation coil wound therearound and a second elongated coil bobbin having a second excitation coil wound therearound, said first elongated coil bobbin and said second elongated coil bobbin being connected in sequence, said first excitation coil being electrically insulated from said second excitation coil, said first excitation coil and said second excitation coil being capable of operating under different voltage, an axially extending cavity within said first elongated coil bobbin and said second elongated coil bobbin, a ferromagnetic frame group having a core section and a contact section, said core section being disposed in and extending through said axially extending cavity in both said first elongated coil bobbin and said second elongated coil bobbin, said contact section extending parallel to said plurality of core sections and positioning outside said first elongated coil bobbin and said second elongated coil bobbin;

an actuator assembly comprising an actuator frame operatively coupled to a first U-shaped ferromagnetic pole piece and a second U-shaped ferromagnetic pole piece, said first U-shaped ferromagnetic pole piece and said second U-shaped ferromagnetic pole piece being identical, and two permanent magnets, said two permanent magnets being identical, said actuator assembly having a first end and a second end, said first U-shaped ferromagnetic pole piece and said second U-shaped ferromagnetic pole piece mounted in back-to-back relation, said first U-shaped ferromagnetic pole piece and said second U-shaped ferromagnetic pole piece operatively coupled to said ferromagnetic frame group; and a means for conductive contact, said means for conductive contact operatively coupled to said first end of said actuator assembly, said ferromagnetic frame group driving said first U-shaped ferromagnetic pole piece and said second U-shaped ferromagnetic pole piece of said actuator assembly, said first end of said actuator assembly either driving said means for conductive contact into contact with a pair of contact points positioned directly opposite said means for conductive contact, said means for conductive contact acting as a conductive pathway between said pair of contact points, or driving said means for conductive contact into breaking contact with said pair of contact points, creating a contact gap between said means for conductive contact and said pair of contact points, each of said pair of contact points connecting to a blow-out magnet, said blow-out magnets and said contact gap together enabling said latching magnetic relay operable with over 200 amps current and over 120 DC voltage.

94. The latching magnetic relay in claim 93 further comprises a housing having a top cover and a bottom cover, a plurality of contact terminal assemblies inserted into and extending through walls of said housing, said relay motor assembly, said actuator assembly and said means for conductive contact being disposed within said housing.

95. A latching magnetic relay assembly comprising:

a relay motor assembly comprising a first elongated coil bobbin having a first excitation coil wound therearound and a second elongated coil bobbin having a second excitation coil wound therearound, said first elongated coil bobbin and said second elongated coil bobbin being connected in sequence, said first excitation coil being electrically insulated from said second excitation coil, said first excitation coil and said second excitation coil being capable of operating under different voltage, an axially extending cavity within said first elongated coil bobbin and said second elongated coil bobbin, a ferromagnetic frame;

an actuator assembly having a first end and a second end, said actuator assembly comprising an actuator frame operatively coupled to two identical U-shaped ferromagnetic pole pieces, said two identical U-shaped ferromagnetic pole pieces being mounted back-to-back on two identical permanent magnets; and a means for conductive contact, said means for conductive contact operatively coupled to said first end of said actuator assembly, said ferromagnetic frame driving said two identical U-shaped ferromagnetic pole pieces of said actuator assembly, said first end of said actuator assembly either driving said means for conductive contact into contact with a pair of contact points positioned directly opposite said means for conductive contact, said means for conductive contact acting as a conductive pathway between said pair of contact points, or driving said means for conductive contact into breaking contact with said pair of contact points, creating a contact gap between said means for conductive contact and said pair of contact points, each of said pair of contact points connecting to a blow-out magnet, said blow-out magnets and said contact gap together enabling said latching magnetic relay to operable with over 200 amps of current and over 120 DC voltage.

96. The latching magnetic relay in claim 95 further comprises a housing having a top cover and a bottom cover, a plurality of contact terminal assemblies inserted into and extending through walls of said housing, said relay motor assembly, said actuator assembly and said means for conductive contact being disposed within said housing.

97. A latching magnetic relay assembly comprising:

a housing;

a group of contact terminal assemblies, each of said group of contact terminal assemblies having at least one pair of contact points, said group of contact terminal assemblies being inserted into and extending through said housing;

a relay motor assembly comprising a first coil bobbin having a first excitation coil and therearound and a second coil bobbin having a second excitation coil wound therearound, said first excitation coil being electrically insulated from said second excitation coil, a ferromagnetic core having a first core end and a second core end, said ferromagnetic core extending within said first coil bobbin and said second coil bobbin, a first ferromagnetic frame, said first ferromagnetic frame having a first end, a second end and a first middle part, said first end being positioned above said first coil bobbin, said second end being positioned below said first coil bobbin, said first middle part being positioned on the side of said first coil bobbin and electro-magnetically coupled with said first core end, and a second ferromagnetic frame, said second ferromagnetic frame having a third end, a fourth end and a second middle part, said third end being positioned above said second coil bobbin, said fourth end being positioned below said second coil bobbin, said second middle part being positioned on the side of said second coil bobbin and electro-magnetically coupled with said second core end, said relay motor assembly being disposed within said housing;

an actuator assembly comprising an actuator frame operatively coupled to a first ferromagnetic pole piece and a second ferromagnetic pole piece, and a plurality of permanent magnets, said actuator frame having a first frame end and a second frame end, said first ferromagnetic pole piece and said second ferromagnetic pole piece mounted in back-to-back relation, said plurality of permanent magnets lying sandwiched therebetween, said actuator assembly being disposed within said housing; and a group of contact bridge assemblies, each of said group of contact bridge assemblies comprising a contact bridge and a spring, said group of contact bridges made of a conductive material and operatively coupled to either said first frame end or said second frame end, said spring connected to said contact bridge, the movement of said actuator assembly either driving said contact bridge into contact with at least one pair of said contact points positioned directly opposite to said contact bridge, said contact bridge serving as a conductive pathway between at least one pair of said contact points, or driving said contact bridge into breaking contact with at least one pair of said contact points, each of said one pair of said contact points connecting to a blow-out magnet, the movement of said actuator assembly driven by said relay motor assembly, said contact bridge assembly being disposed within said housing.

98. The latching magnetic relay assembly in claim 97, wherein said top cover is identical to said bottom cover.

99. The latching magnetic relay assembly in claim 97, wherein said first ferromagnetic pole piece is magnetically coupled to said first end of said first ferromagnetic frame when said second ferromagnetic pole piece is magnetically coupled to said fourth end of said second ferromagnetic frame.

100. The latching magnetic relay assembly in claim 97, wherein said first ferromagnetic pole piece is magnetically coupled to said second end of said first ferromagnetic frame when said second ferromagnetic pole piece is magnetically couple to said third end of said second ferromagnetic frame.

101. The latching magnetic relay assembly in claim 97, wherein a plurality of said groups of contact bridge assemblies are operatively coupled to either said first frame end or said second frame end, said plurality of said groups of contact bridge assemblies being electrically insulated from one another.

102. The latching magnetic relay assembly in claim 97, wherein a plurality of said contact buttons are conductively connected to each of said group of contact bridges.

103. A latching magnetic relay assembly comprising:

a relay motor assembly comprising a first coil bobbin having a first excitation coil wound therearound and a second coil bobbin having a second excitation coil wound therearound, said first excitation coil being electrically insulated from said second excitation coil, an axially extending cavity within said first coil bobbin and said second coil bobbin, a ferromagnetic core, said ferromagnetic core extending within said first coil bobbin and said second coil bobbin, a first ferromagnetic frame, said first ferromagnetic frame having a first end, a second end and a first middle part, said first end being positioned above said first coil bobbin, said second end being positioned below said first coil bobbin said first middle part being positioned vertically to said ferromagnetic core and electro-magnetically coupled with said ferromagnetic core, and a second ferromagnetic frame, said second ferromagnetic frame having a third end, a fourth end and a second middle part, said third end being positioned above said second coil bobbin, said fourth end being positioned below said second coil bobbin, said second middle part being positioned vertically to said ferromagnetic core and electro-magnetically coupled with said ferromagnetic core;

an actuator assembly comprising an actuator frame operatively coupled to a first ferromagnetic pole piece and a second ferromagnetic pole piece, and two permanent magnets, said actuator assembly having a first actuator end and a second actuator end, said first ferromagnetic pole piece and said second ferromagnetic pole piece mounted in back-to-back relation, said first ferromagnetic pole piece having a fifth contact section and a sixth contact section, said second ferromagnetic pole piece having a seventh contact section and an eighth contact section, said two permanent magnets lying sandwiched therebetween, said actuator assembly being positioned so said first contact section and said second contact section being located in between said fifth contact section and said sixth contact section, said seventh contact section and said eighth contact section being located in between said third contact section and said fourth contact section, said first ferromagnetic pole piece being located in overlapping relation across from said first contact section and said second contact section, said second ferromagnetic pole piece being located in overlapping relation across from said third contact section and said fourth contact section, said first ferromagnetic pole piece magnetically coupled to said first end of said first ferromagnetic frame when said second ferromagnetic pole piece magnetically coupled to said fourth end of said second ferromagnetic frame, and said first ferromagnetic pole piece magnetically coupled to said second end of said first ferromagnetic frame when said second ferromagnetic pole piece magnetically couple to said third end of said second ferromagnetic frame; and means for conductive contact, said means for conductive contact operatively coupled to said first actuator end of said actuator assembly, the movement of said actuator assembly either driving said means for conductive contact into contact with a pair of contact points positioned directly opposite to said means for conductive contact, said means for conductive contact acting as a conductive pathway between said pair of contact points, or driving said means for conductive contact into breaking contact with said pair of contact points, each of said pair of contact points connecting to a blow-out magnet, the movement of said actuator assembly initiated by said relay motor assembly.

104. The latching magnetic relay in claim 103 further comprises a housing having a top cover and a bottom cover, a plurality of contact terminal assemblies inserted into and extending through walls of said housing, said relay motor assembly, said actuator assembly and said means for conductive contact being disposed within said housing.

105. The latching magnetic relay assembly in claim 104, wherein a plurality of said contact buttons are conductively connected to said means for conductive contact.

106. The latching magnetic relay assembly in claim 105, wherein said means for conductive contact is into contact with said pair of contact points when said seventh contact section is into contact with said third contact section and said second contact section is into contact with said sixth contact section.

107. The latching magnetic relay assembly in claim 106, wherein said means for conductive contact is in breaking contact with said pair of contact points when said seventh contact section is in breaking contact with said third contact section and said second contact section is in breaking contact with said sixth contact section.

108. The latching magnetic relay assembly in claim 107, wherein a plurality of said means for conductive contact are operatively coupled to said first actuator end of said actuator assembly, said plurality of said means for conductive contact being electrically insulated from one another.

* * * * *